US009167900B2

(12) United States Patent
Geismar et al.

(10) Patent No.: US 9,167,900 B2
(45) Date of Patent: Oct. 27, 2015

(54) SEAT FURNITURE HAVING A RAPIDLY ADJUSTABLE FRAME

(76) Inventors: Tile Geismar, Hamburg (DE); Arne Julian Ehrhorn, Buenos Aires/Capital Federal (AR)

( * ) Notice: Subject to any disclaimer, the term of this patent is extended or adjusted under 35 U.S.C. 154(b) by 590 days.

(21) Appl. No.: 13/511,350

(22) PCT Filed: Nov. 15, 2010

(86) PCT No.: PCT/DE2010/001348

§ 371 (c)(1),
(2), (4) Date: May 22, 2012

(87) PCT Pub. No.: WO2011/060766

PCT Pub. Date: May 26, 2011

(65) Prior Publication Data

US 2012/0235454 A1 Sep. 20, 2012

(30) Foreign Application Priority Data

Nov. 23, 2009 (AR) ..... 20090104500
Jun. 15, 2010 (AR) ..... 20100102120

(51) Int. Cl.
*A47C 1/00* (2006.01)
*A47C 3/26* (2006.01)
*A47C 3/04* (2006.01)

(52) U.S. Cl.
CPC .... *A47C 3/26* (2013.01); *A47C 3/04* (2013.01)

(58) Field of Classification Search
USPC ..... 297/19, 313, 337, 338, 344.18, 316, 297/320, 340, 344.12, 446.1, 447.3, 447.4, 297/448.1, 451.1
See application file for complete search history.

(56) References Cited

U.S. PATENT DOCUMENTS 1,713,034 A * 5/1929 Denson et al. ..... 108/4
2,128,522 A 8/1938 Burns et al.

(Continued)

FOREIGN PATENT DOCUMENTS

DE 251723 C 10/1912
FR 355112 A 10/1905

(Continued)

OTHER PUBLICATIONS

International Search Report for corresponding International Application PCT/DE2010/001348.

*Primary Examiner* — David R Dunn
*Assistant Examiner* — Alexander Harrison
(74) *Attorney, Agent, or Firm* — WRB-IP LLP

(57) ABSTRACT

Seat furniture includes a frame which is adjustable such that the height and inclination of the seat supported by the frame can be easily and rapidly varied. The seat furniture includes a seat platform, which is supported by an adjustable frame, in which two pairs of legs are integrated, the height-adjustment devices of which have locking devices which are operated by operating elements located near the seat platform. When the front operating device is operated, the movable locking devices of the front pair of legs are released. The height of the front pair of legs can then be varied. The set of the corresponding rear elements functions in the same manner. Articulated hinges integrated in the frame permit each adjustment while the support area on the floor does not change. The adjustable frame is configured in such a way, in particular in regard to the rear legs and the frame braces, that a cavity remains for a stacking fit which is compatible with the shape and the dimensions of the seat platform and the other structural elements and the operating elements, and consequently several units can be stacked one on top of the other.

9 Claims, 24 Drawing Sheets

(56) References Cited

U.S. PATENT DOCUMENTS

| | | | | |
|---|---|---|---|---|
| 3,074,759 | A * | 1/1963 | Bergenwall | 297/318 |
| 5,246,265 | A * | 9/1993 | Nagan et al. | 297/54 |
| 5,667,274 | A * | 9/1997 | Blackman | 297/338 |
| 6,488,335 | B1 * | 12/2002 | Cioncada | 297/300.2 |
| 6,851,752 | B2 * | 2/2005 | Asbach | 297/344.12 |
| 7,025,415 | B1 * | 4/2006 | Wu | 297/119 |
| 8,459,741 | B2 * | 6/2013 | Mazzola et al. | 297/344.18 |
| 8,794,703 | B2 * | 8/2014 | Bateman et al. | 297/344.18 |
| 2007/0236054 | A1 | 10/2007 | Bateman et al. | |
| 2009/0195040 | A1 * | 8/2009 | Birkbeck | 297/317 |
| 2013/0328360 | A1 * | 12/2013 | Kim | 297/183.1 |

FOREIGN PATENT DOCUMENTS

| | | | |
|---|---|---|---|
| FR | 2445125 | A1 | 7/1980 |
| GB | 689273 | A | 3/1953 |

* cited by examiner

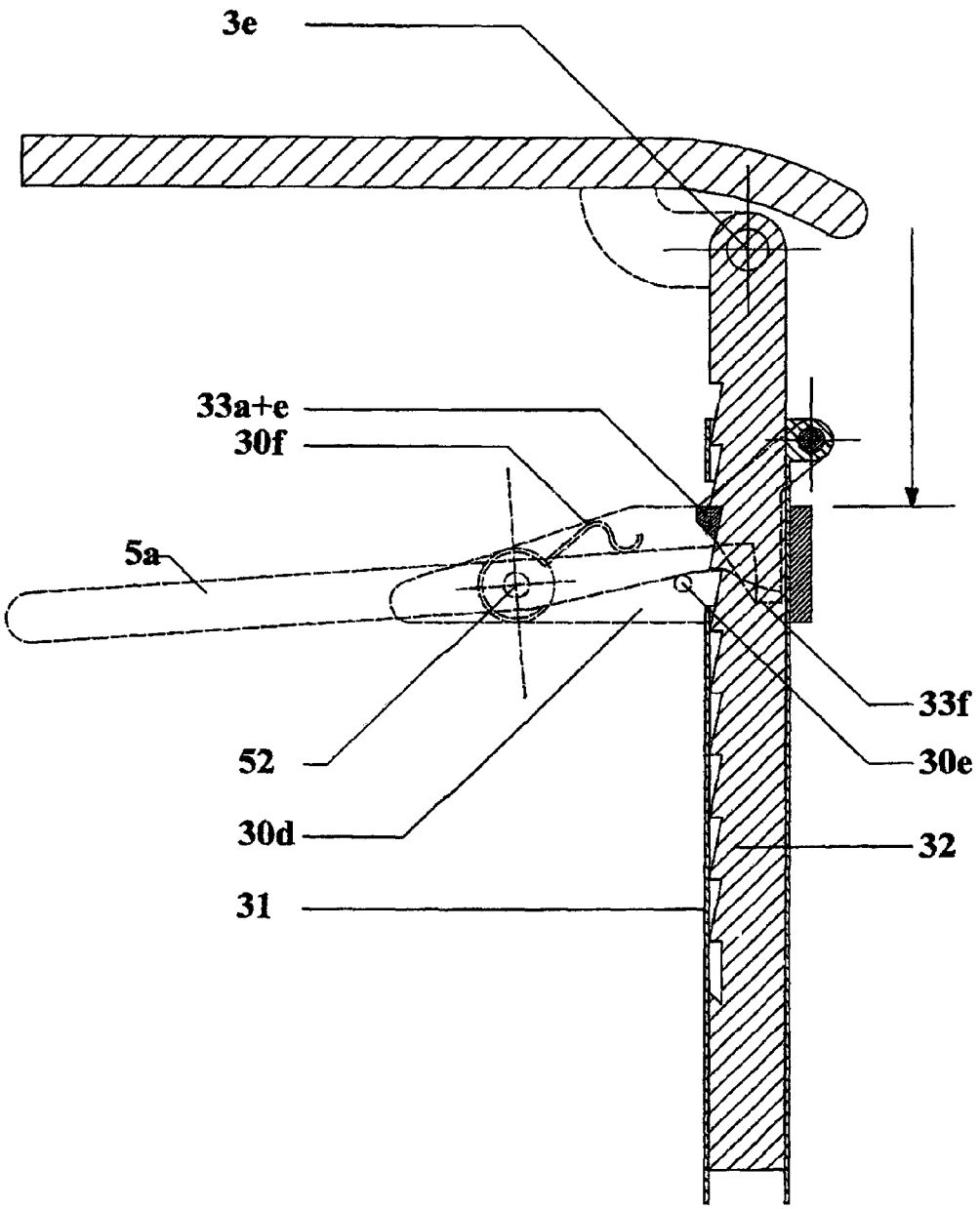
FIG.17/A

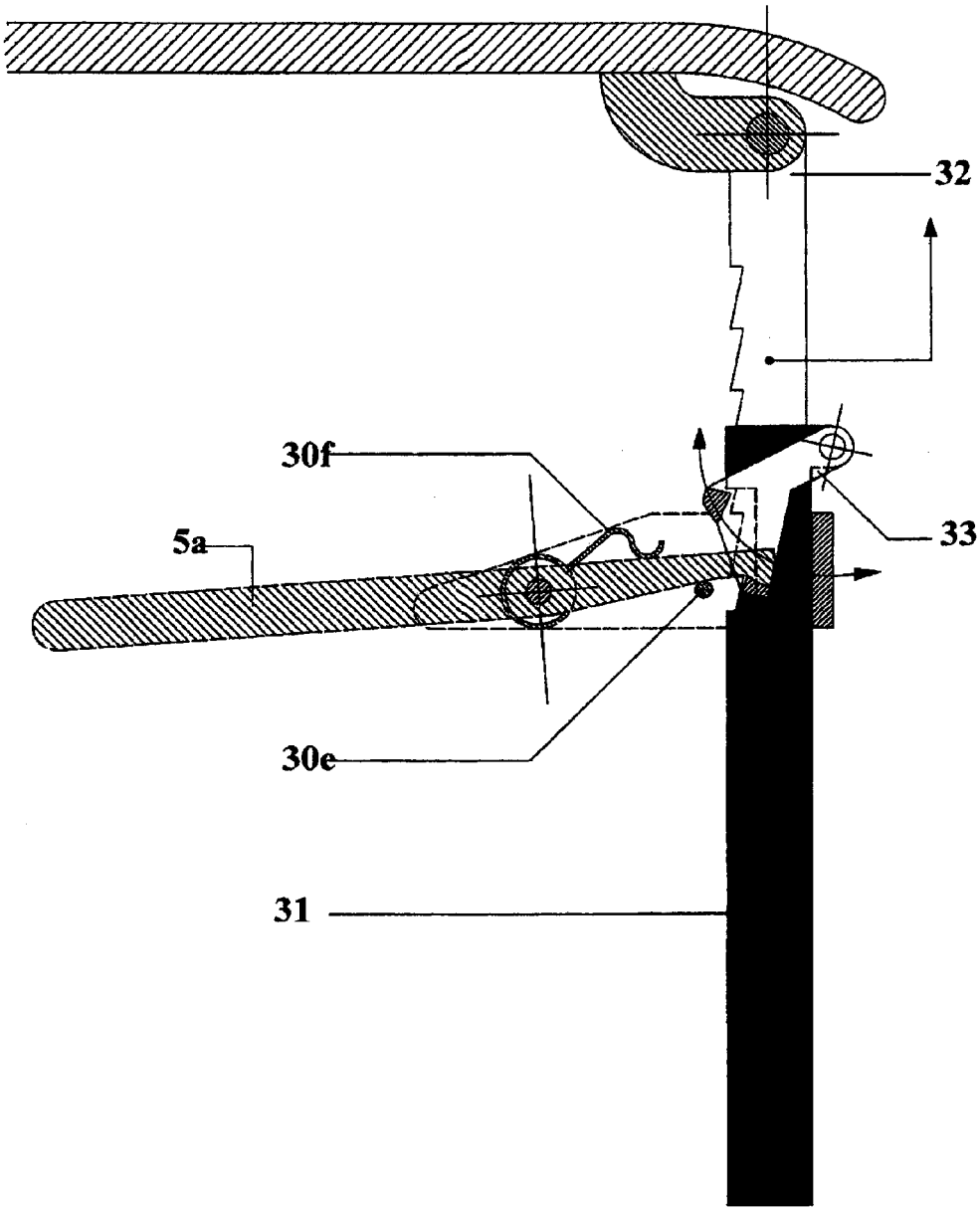
FIG.17/B

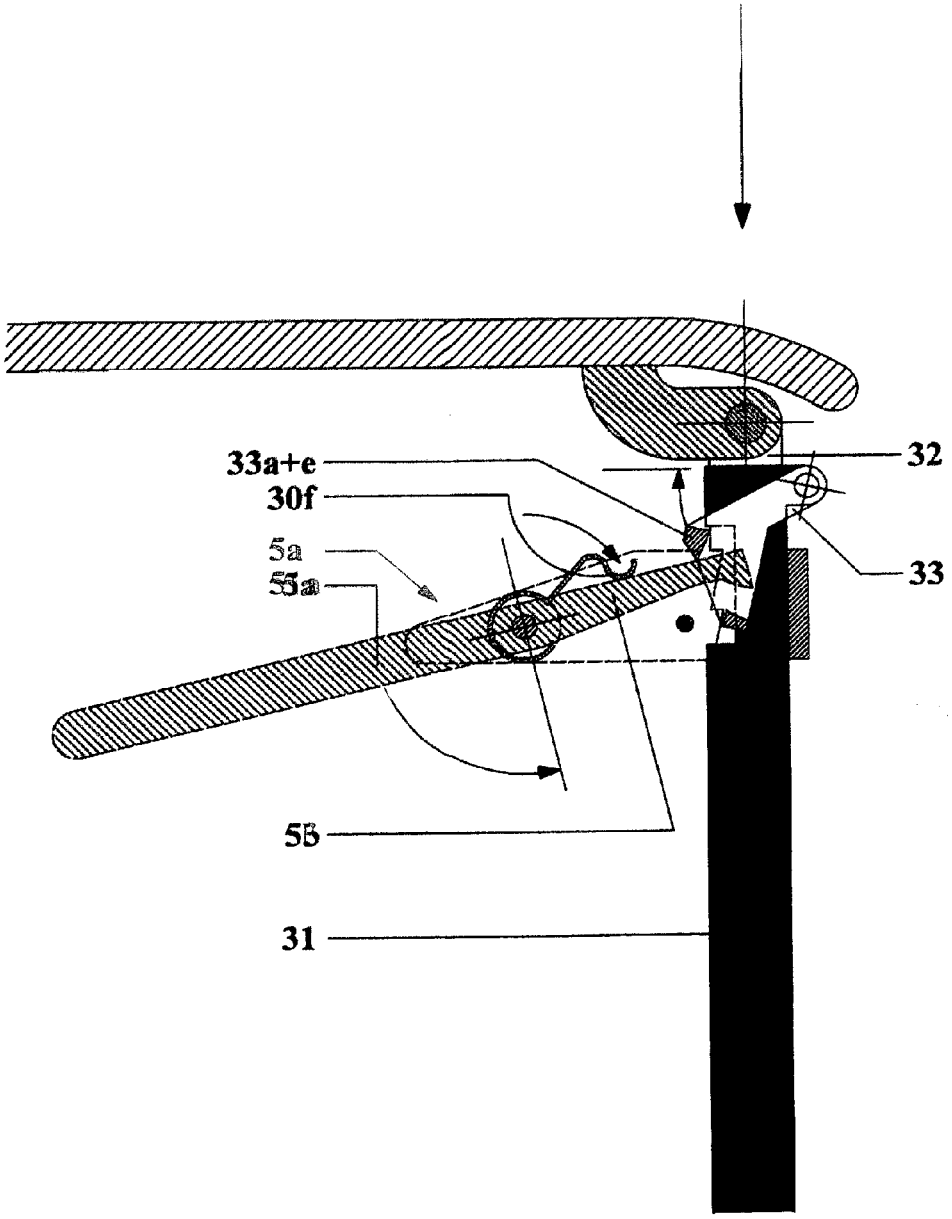
FIG.17/C

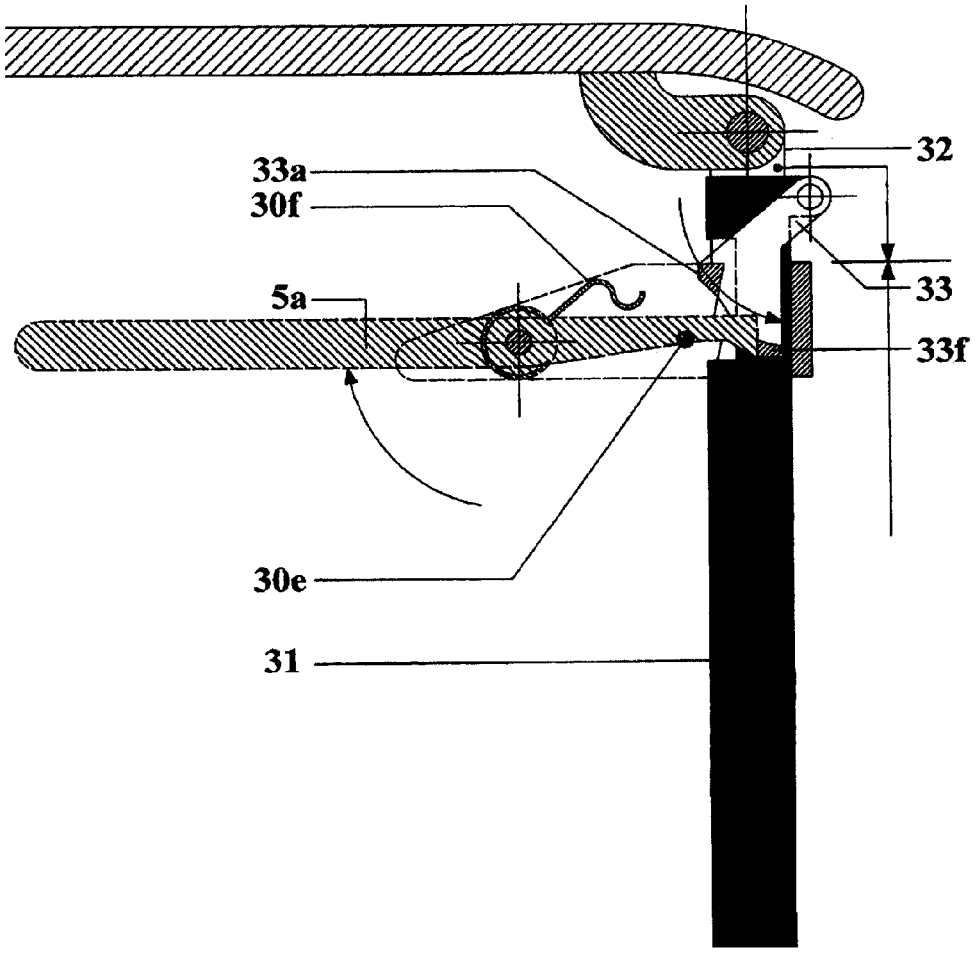
FIG.17/D

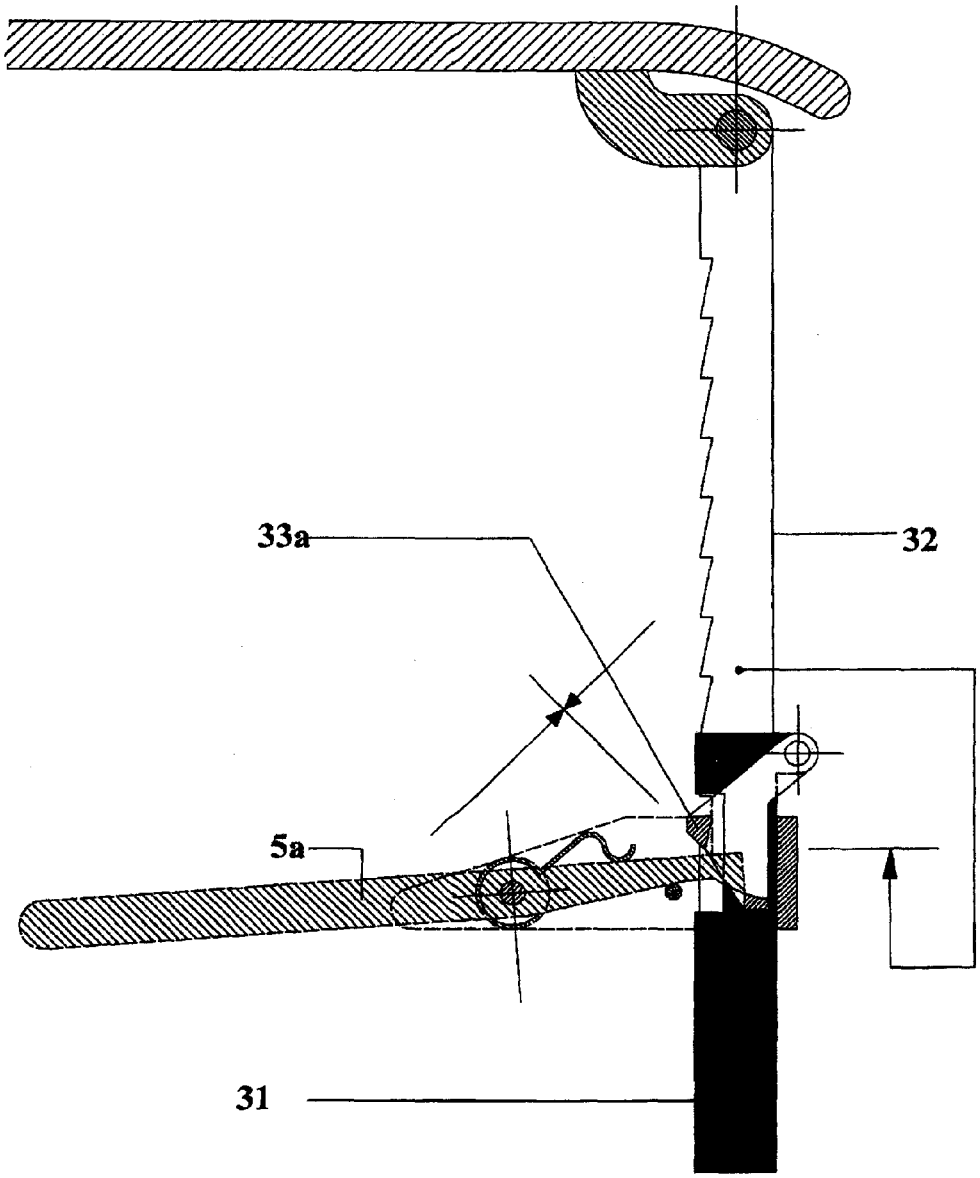
FIG.17/E

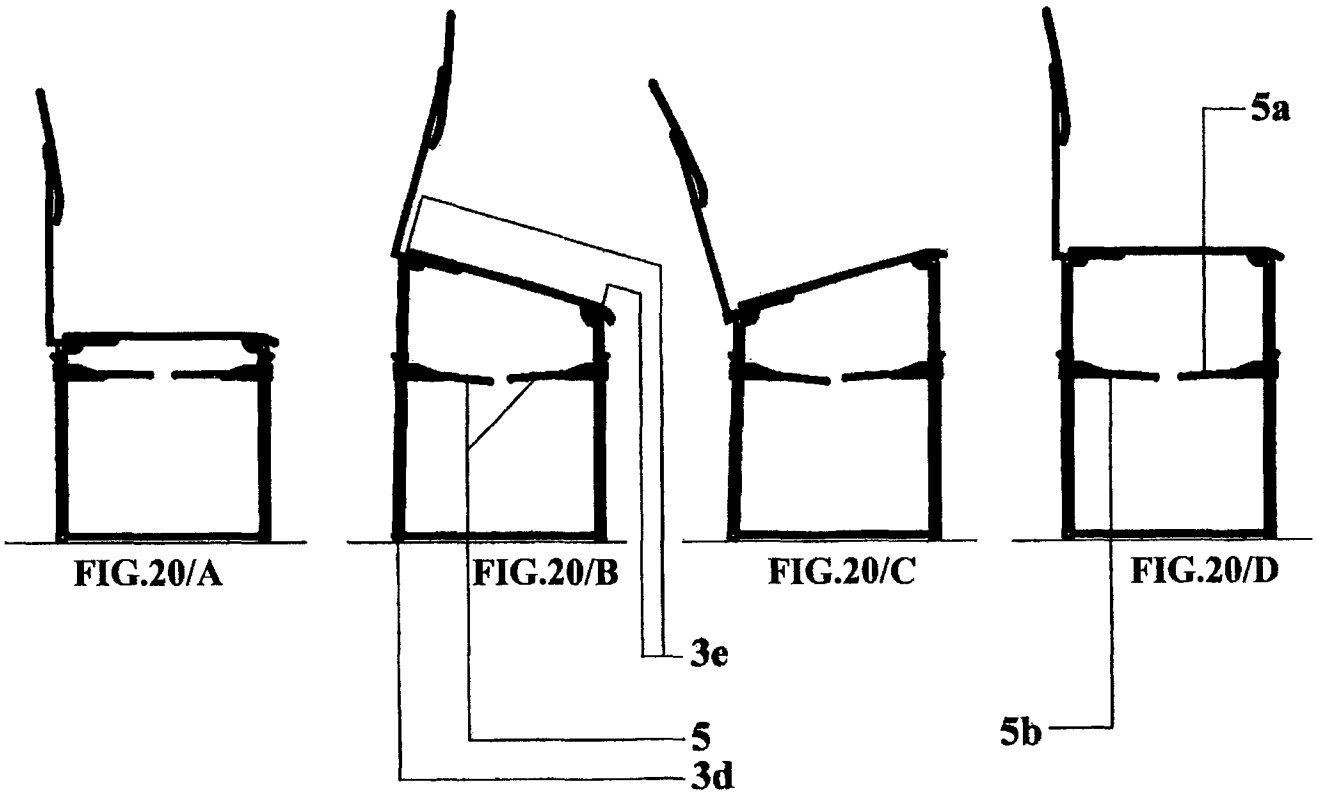
FIG.20/A/B/C/D

SEAT FURNITURE HAVING A RAPIDLY ADJUSTABLE FRAME

BACKGROUND AND SUMMARY

The present invention makes a contribution to seat furniture articles that are used daily, in particular stools and chairs.

It concerns seat furniture comprising an adjustable frame, which is quickly and easily adjustable in regard to height and inclination and thus can meet a wide range of ergonomic requirements and large numbers of which can be transported and stored due to the fact that the furniture can be stacked.

To date a number of different adjustable seat furniture types are known that allow the adjustment of one or a plurality of components; some of them can be stacked.

For example, U.S. Pat. No. 5,516,197 refers to an adjustable chair in which some of the legs can be adjusted. The design of this chair is such that the adjustment of height and seat inclination appears to be slow and labor-intensive.

U.S. Pat. Nos. 2,098,888, 2,169,32 and 4,240,663 are also known and describe stackable chairs but do not have any adjustment mechanisms that go beyond form or materials based flexibility.

U.S. Pat. No. 2,745,468 shows a flexible chair that is comprised of a rigid frame and a seat with a back—made of one piece—which can move back and forth slightly on said frame. This chair does not provide any additional devices for adjusting the height or fixing any positions.

Also known is U.S. Pat. No. 3,328,075 which introduces a frame that allows chairs to be coupled on the sides and can be stacked, but does not provide any adjustment devices or adaptation possibilities to different ergonomic requirements.

U.S. Pat. No. 4,238,097 shows a chair for orchestra conductors or contrabass players that is adapted to the adjustment combinations of certain stage pedestals. It shows devices that are operated individually by hand. The seat rests on a central, telescopically adjustable center column, however, its inclination cannot be adjusted and the structure does not allow for any stacking.

Furthermore, U.S. Pat. No. 4,306,750 is known that introduces a chair that was developed especially for musicians. Although it can be stacked, it does not provide any adjustment mechanisms at all.

U.S. Pat. No. 4,671,570 presents a stackable chair. The shape of the seat area can be adjusted; however, there is no device for height adjustment.

Finally, U.S. Pat. Nos. 5,035,466 and 5,048,893 should be mentioned that introduce chairs whose seats rest on a column whose length can be adjusted and whose lower end comprises braces that are fastened in a star-shaped arrangement and provide for secure standing. However, these chairs cannot be stacked on other chairs of the same type.

The invention that is introduced here offers different advantages and conveniences:

It comprises position adjustment devices that allow for the independent adjustment of the height of the front or rear chair legs, which in turn results in an adjustment of the height and inclination of the seat. The four legs can be adjusted simultaneously, or the front or rear pairs of legs can be adjusted successively in random order.

The adjustment is easy and quick. It can be done with one hand. It may be possible to use a foot.

The configuration also ensures stacking.

The upper and lower articulated hinges that are integrated in the frame permit each adjustment while the support area on the floor does not change.

The adjustment devices of the legs and the upper and lower articulated hinges provide this seat furniture with a high degree of versatility for the user as well as for service personnel without affecting its simple, exterior appearance.

DESCRIPTION OF THE DRAWINGS

To ensure a better understanding of the invention, this document is accompanied by different figures which show two preferred embodiments—always in the sense of an explanation and not in the sense of a limitation.

Drawing A, a profile view outline, shows how the adjustability of the frame allows the seat to incline forward.

Drawing B, a profile view outline, shows how the adjustability of the frame allows the seat to incline backward.

Drawing C, a profile view outline, shows how the adjustability of the frame allows for a reduction of the seat height.

Drawing D, a profile view outline, shows how the adjustability of the frame allows for an increase in the seat height.

Figure 2:
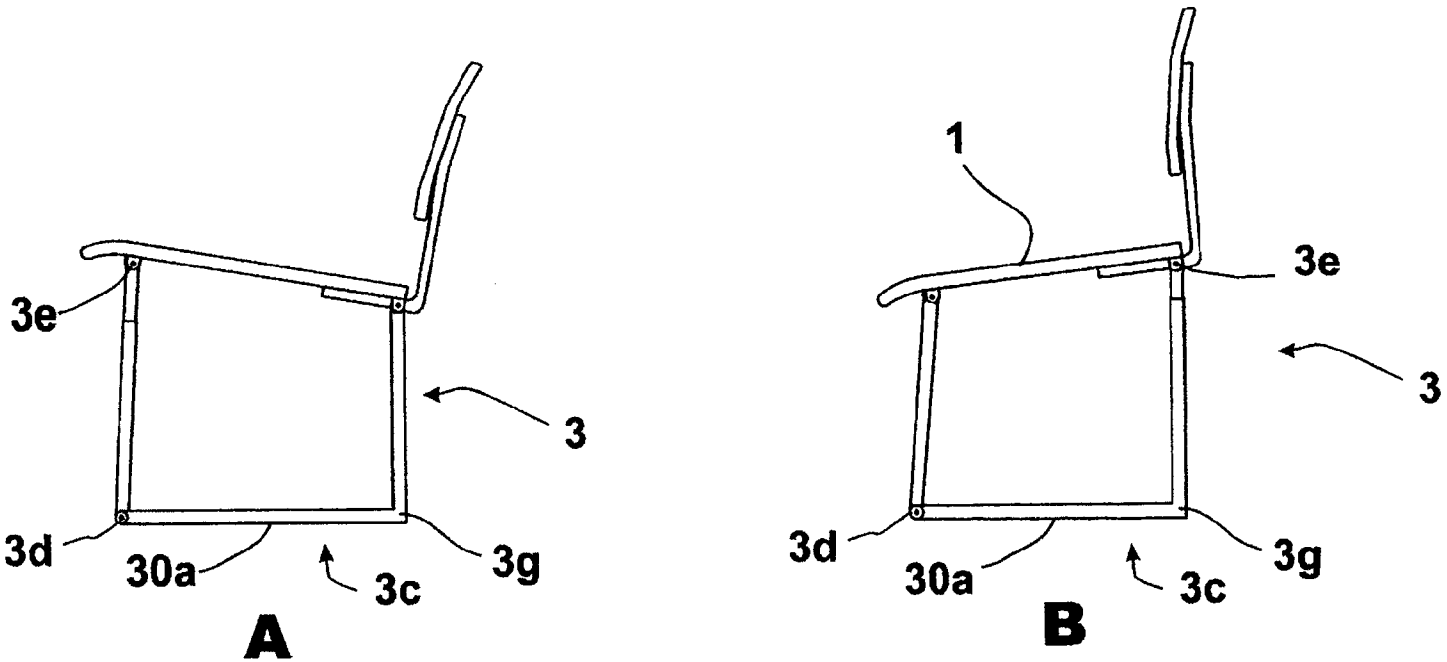

FIG. 2 shows the embodiment of a chair with articulated hinges at the upper front and rear and lower front and comprises drawings A and B:

Drawing A, a profile view outline, shows how the adjustability of the frame allows the seat to incline backward.

Drawing B, a profile view outline, shows how the adjustability of the frame allows the seat to incline forward.

Figure 3:
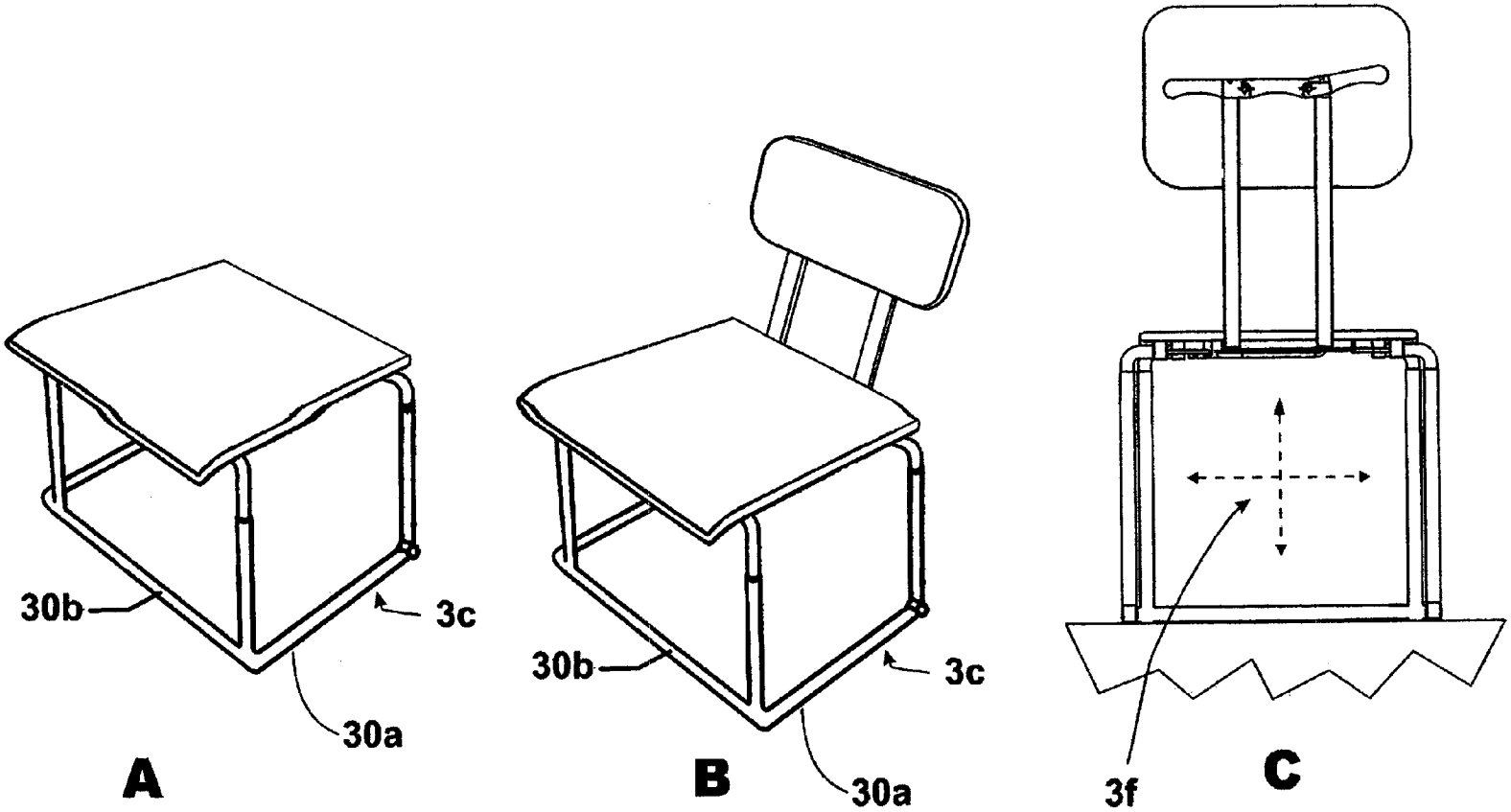

FIG. 3 comprises drawings A, B, and C:

Drawing A, a perspective view, shows an embodiment of the seat without chair back.

Drawing B, a perspective view, shows the seat as a chair in an embodiment with chair back, and Drawing C, aback view outline, shows the structure of the chair and its cavity for stacking.

Figure 4:
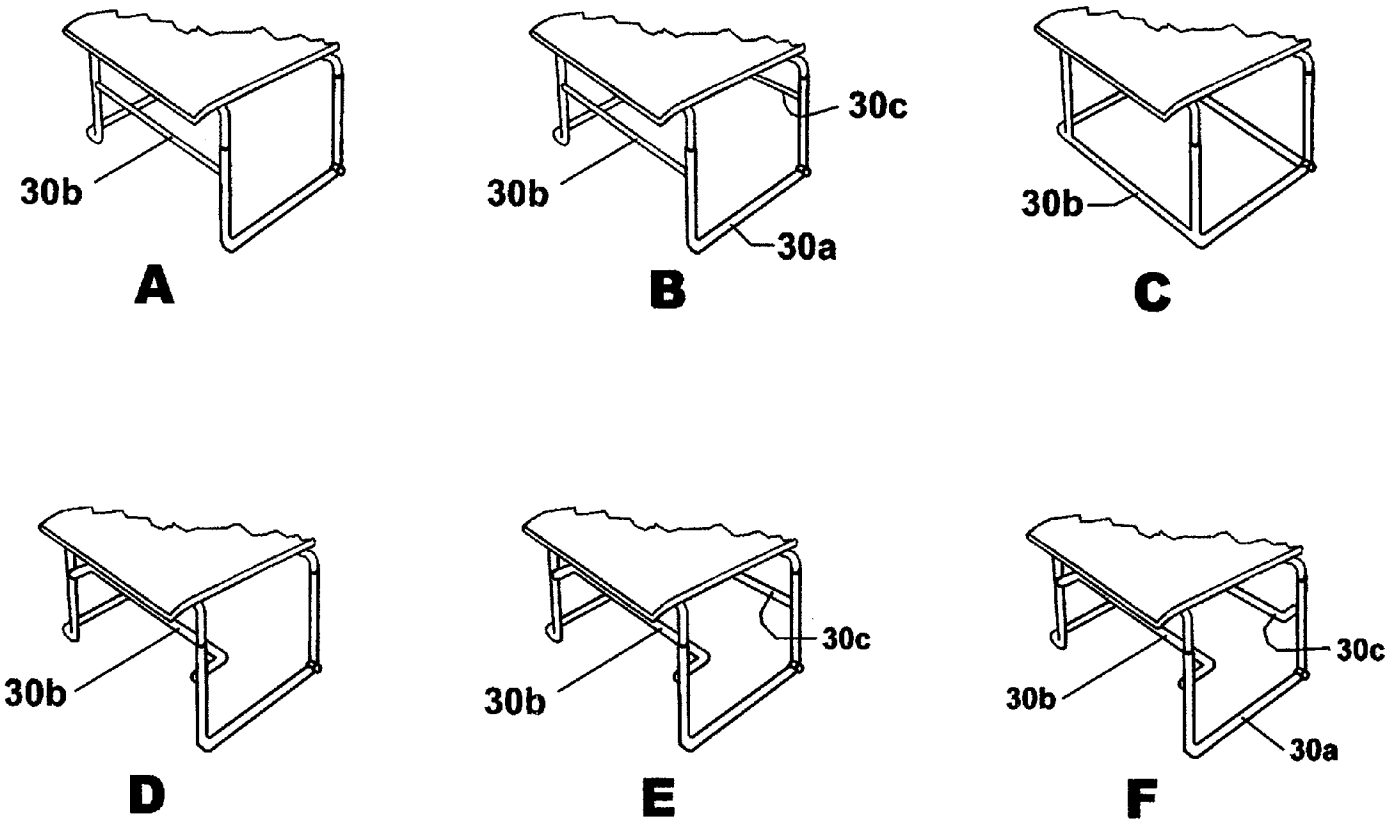

FIG. 4 comprises drawings A, B, C, D, E, and F:

Drawing A, a perspective view of the base frame, shows an embodiment with a front cross brace in the upper area of the adjustable frame.

Drawing B, a perspective view of the base frame, shows a different embodiment with a front and a rear cross brace in the upper area of the adjustable frame.

Drawing C, a perspective view of the base frame, shows a different embodiment with a front and a rear cross brace in the lower area of the adjustable frame.

Drawing D, a perspective view of the base frame, shows a different embodiment with a latching front cross brace in the upper area of the adjustable frame.

Drawing E, a perspective view of the base frame, shows a different embodiment with a latching front cross brace and a rear cross brace in the upper area of the adjustable frame, and Drawing F, a perspective view of the base frame, shows a different embodiment with a latching front and a latching rear cross brace in the upper area of the adjustable frame.

Figure 5:
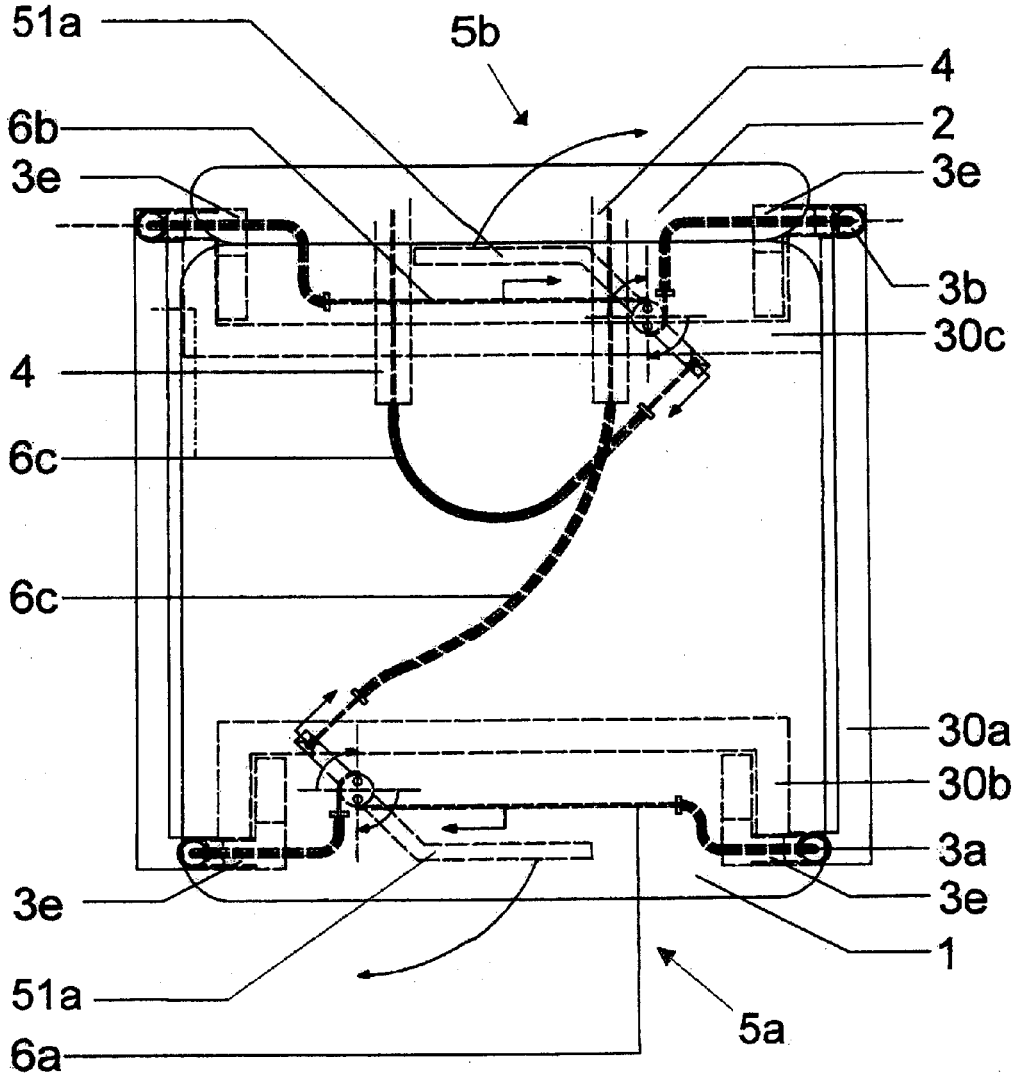

FIG. 5 is an outline that shows the operating elements and cable pulls below the seat and also shows the position of the braces, as they are indicated in FIG. 4F.

Figure 6:
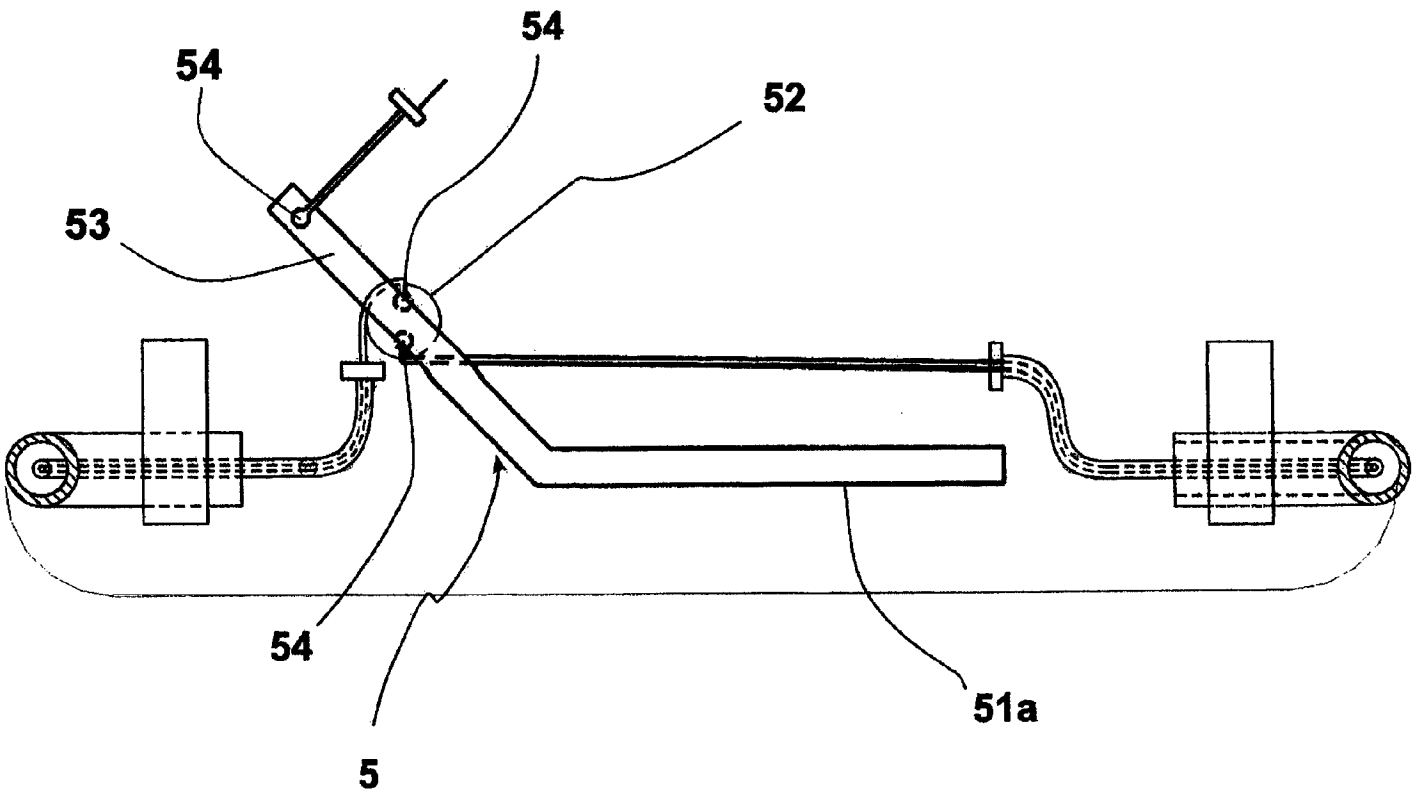

FIG. 6 shows a detailed section of the outline of FIG. 5.

Figure 7:
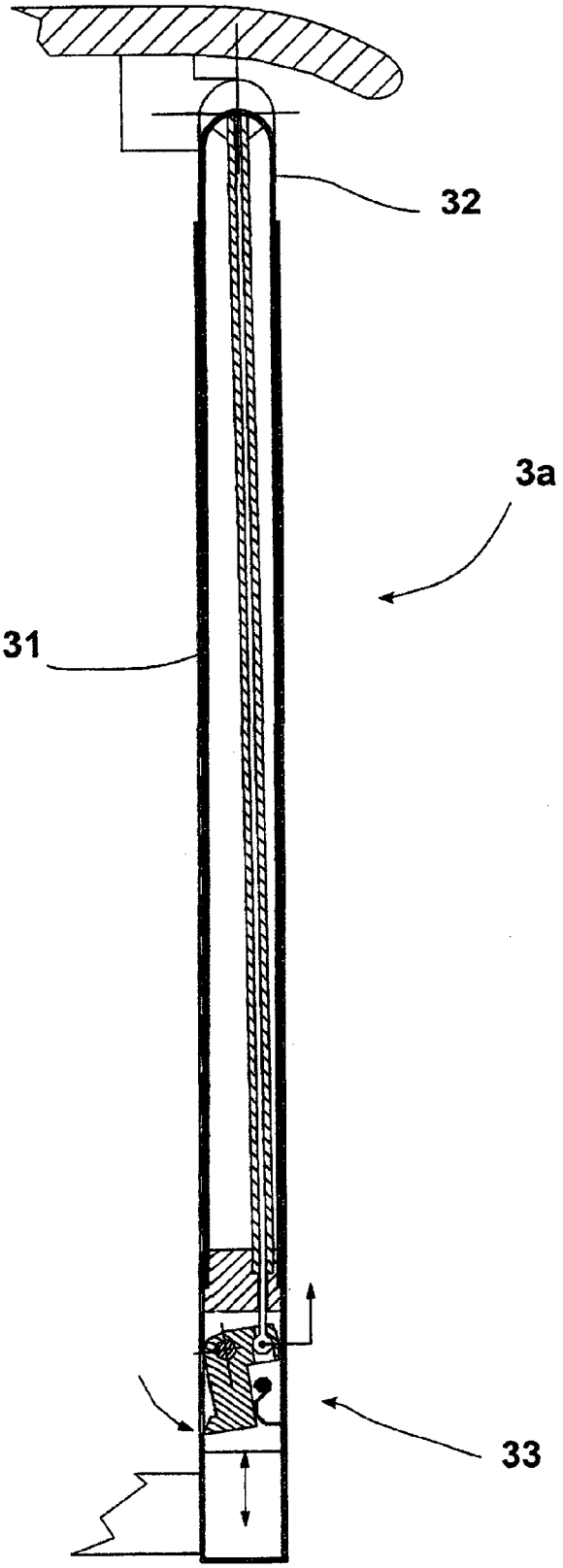

FIG. 7 is a longitudinal section through a front leg in whose inside the moveable locking device and a cable pull can be seen.

Figure 8:
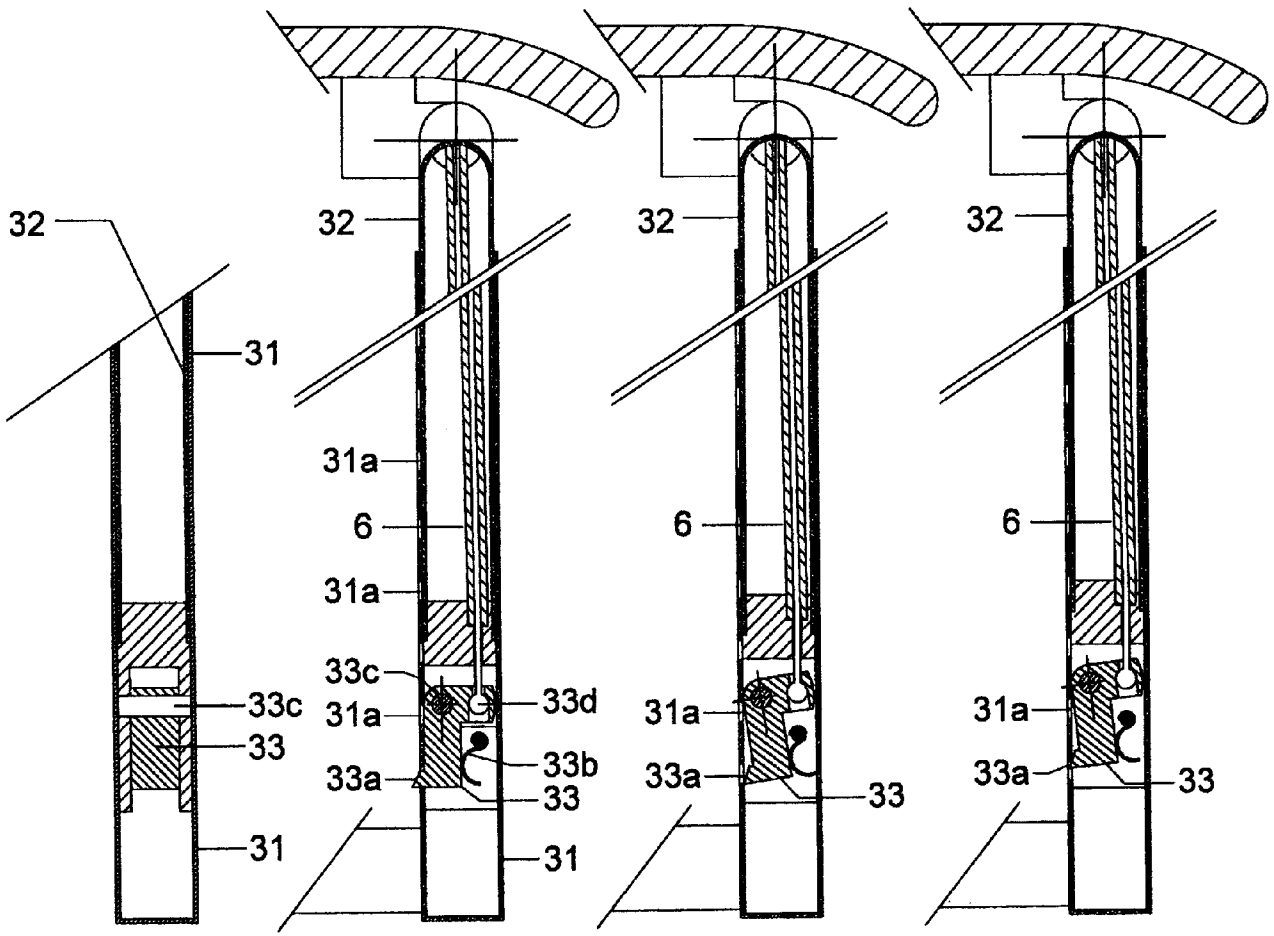

FIG. 8 comprises drawings A, B, C, and D:

Drawing A shows a longitudinal section through a leg in the plane of the hinge of the moveable locking device.

Drawing B shows a longitudinal section through a front leg in which the moveable locking device can be seen in locked position with regard to the telescopic leg structure.

Drawing C shows a longitudinal section through a front leg in which the locking device function of the moveable locking device with regard to the telescopic leg structure is released, which allows the telescopic structure to be adjusted freely in both directions and Drawing D shows a longitudinal section through a front leg in which the moveable locking device is halfway retracted, which is a situation in which the locking device yields passively when the telescopic leg is pulled out, but blocks the pushing together of the telescopic segments.

Figure 9:
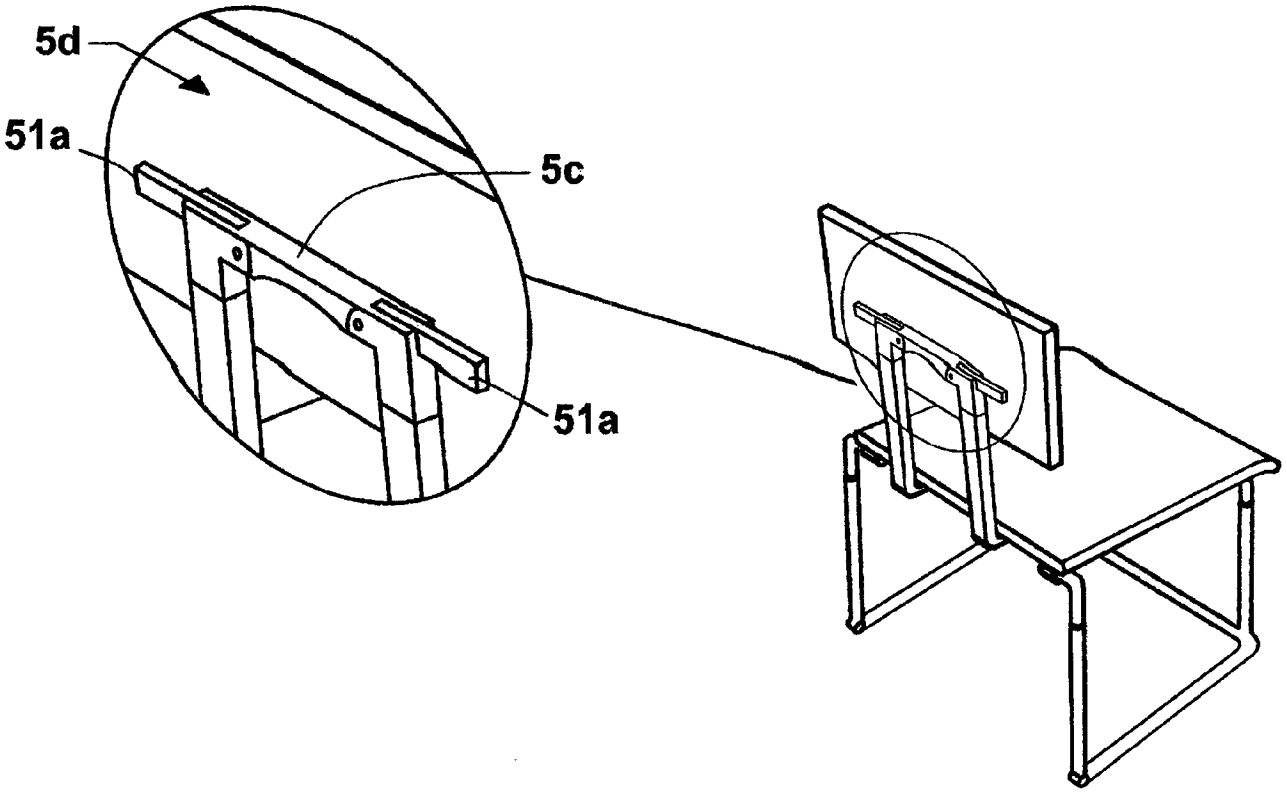

FIG. 9 shows a perspective back view which shows the operating elements behind the chair back, i.e. in this case the upper operating elements that are comprised of individual lever handles and a central handle for the simultaneous pull operation.

Figure 10:
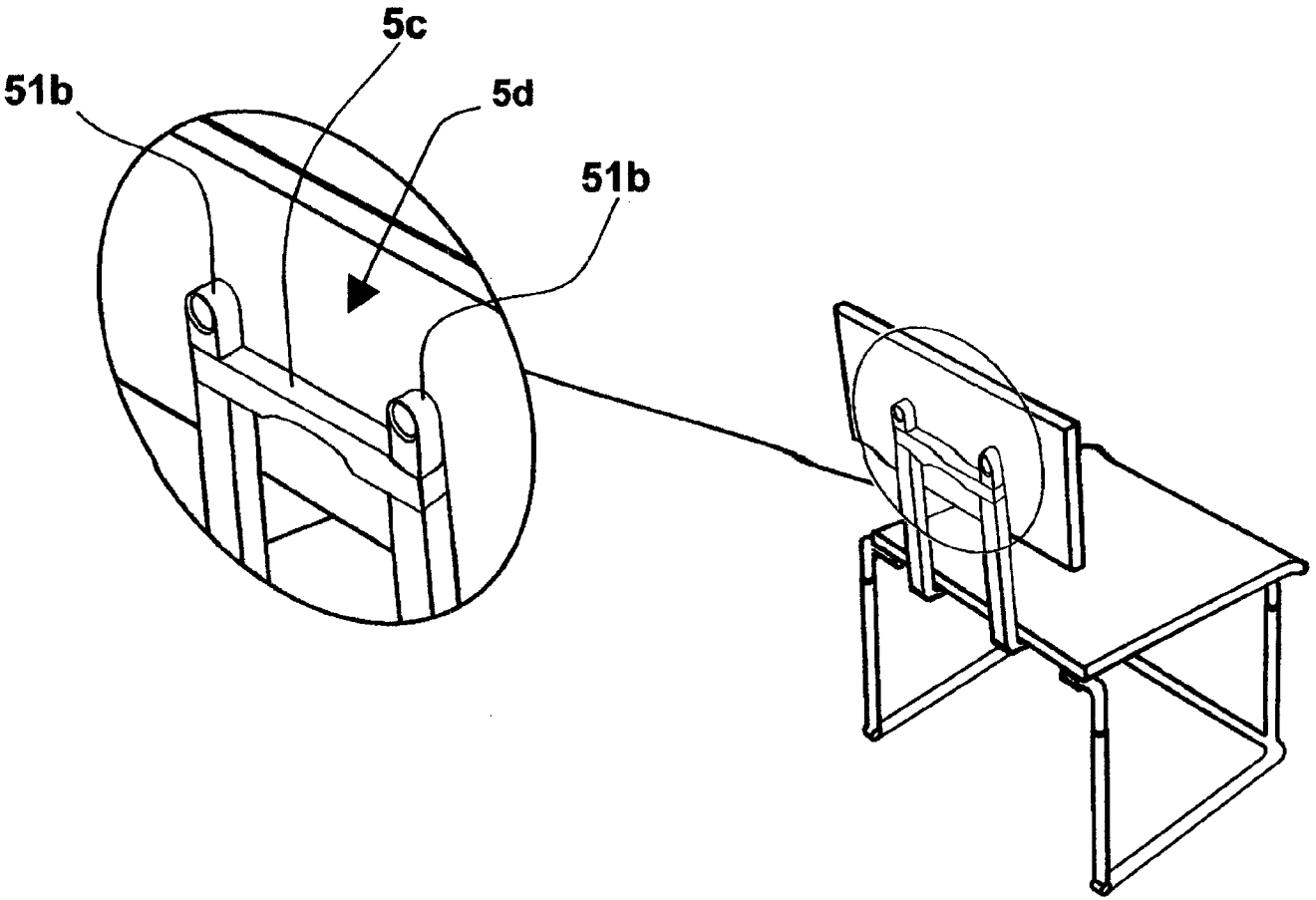

FIG. 10 shows a perspective back view which shows the operating elements behind the chair back, i.e. in this case the upper operating elements that are comprised of individual pull handles and a central handle for the simultaneous pull operation.

Figure 11:
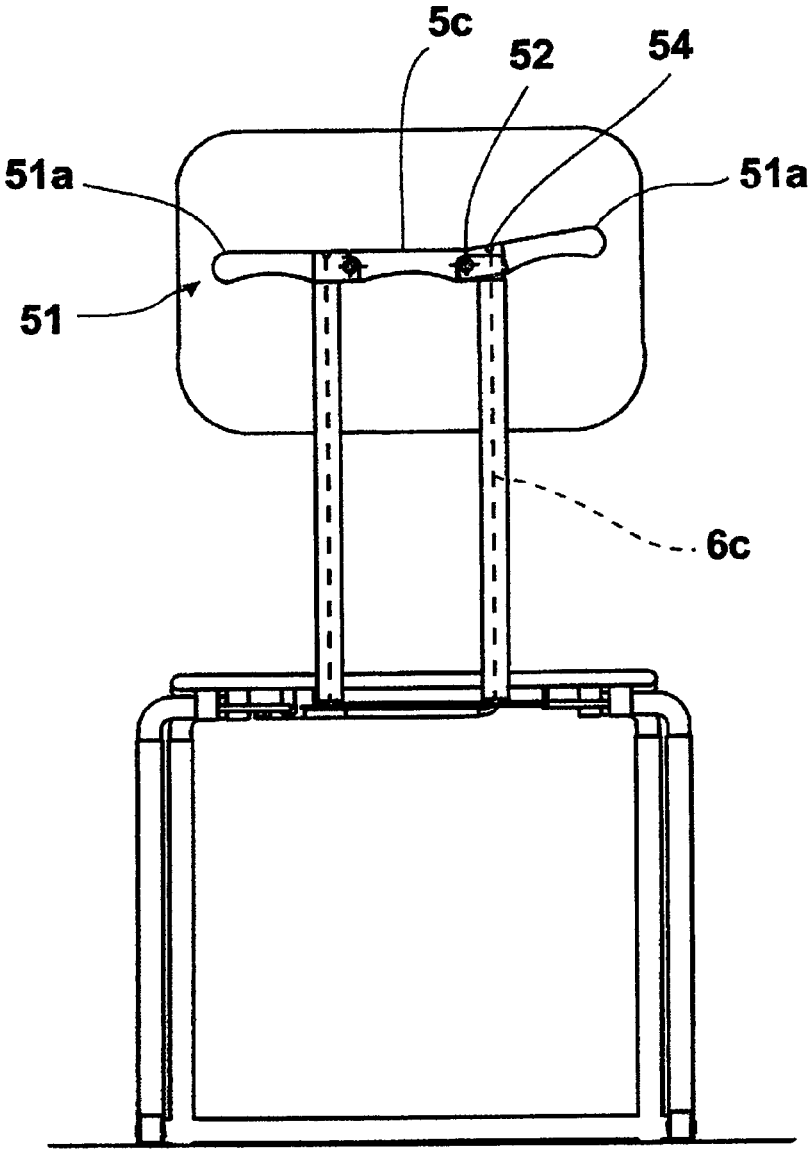

FIG. 11 shows an outline of a back view of the chair with the frame constellation shown in FIG. 3, in which a lever handle exerts pull on the respective cable.

Figure 12:
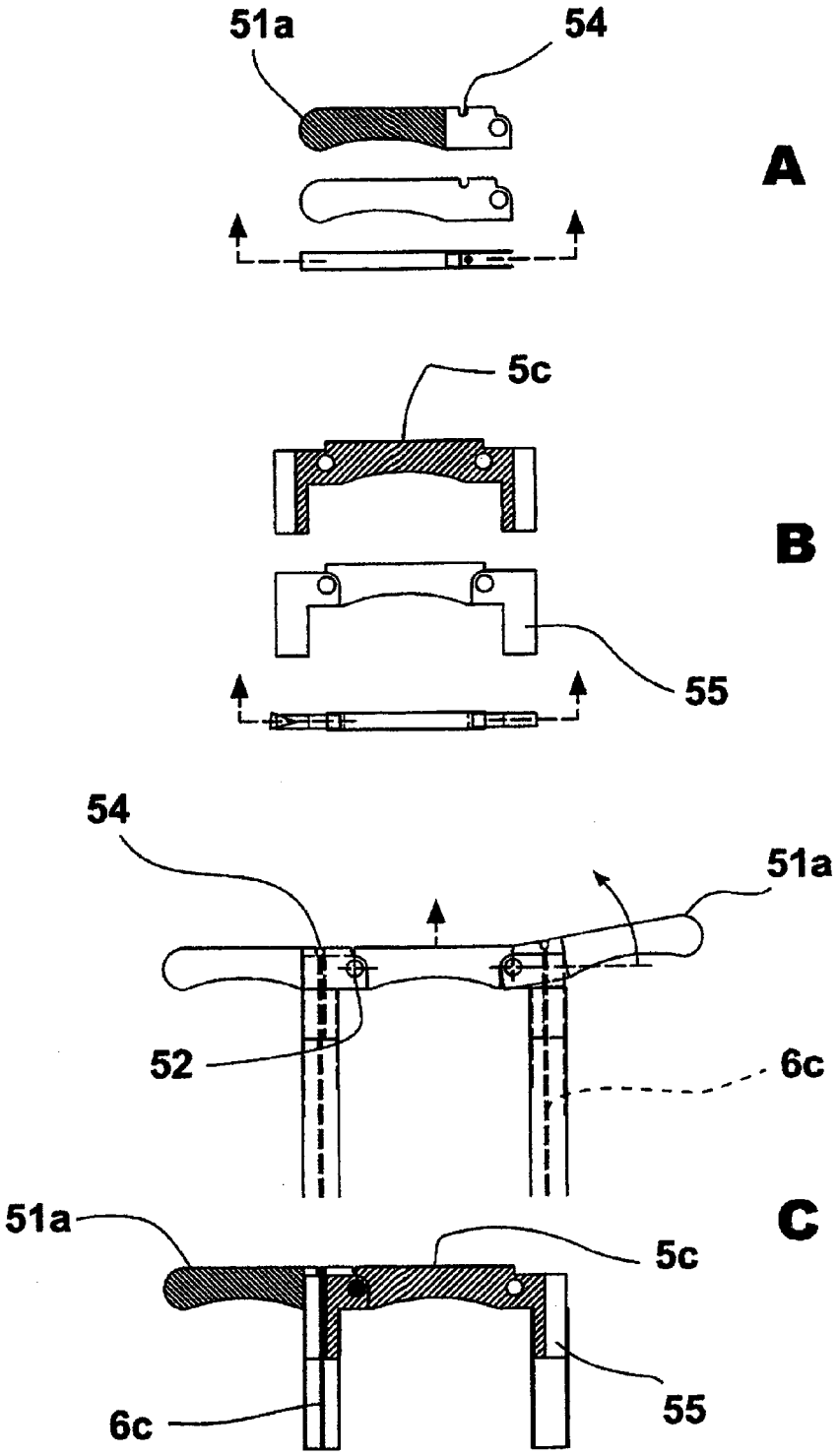

FIG. 12 comprises drawings A, B, and C that show different views—from the side, from the top and longitudinal sections—which disclose the disposition and connection of the individual parts of the upper operating elements including the simultaneous pull operation and their respective mode of operation on the cable pulls.

Figure 13:
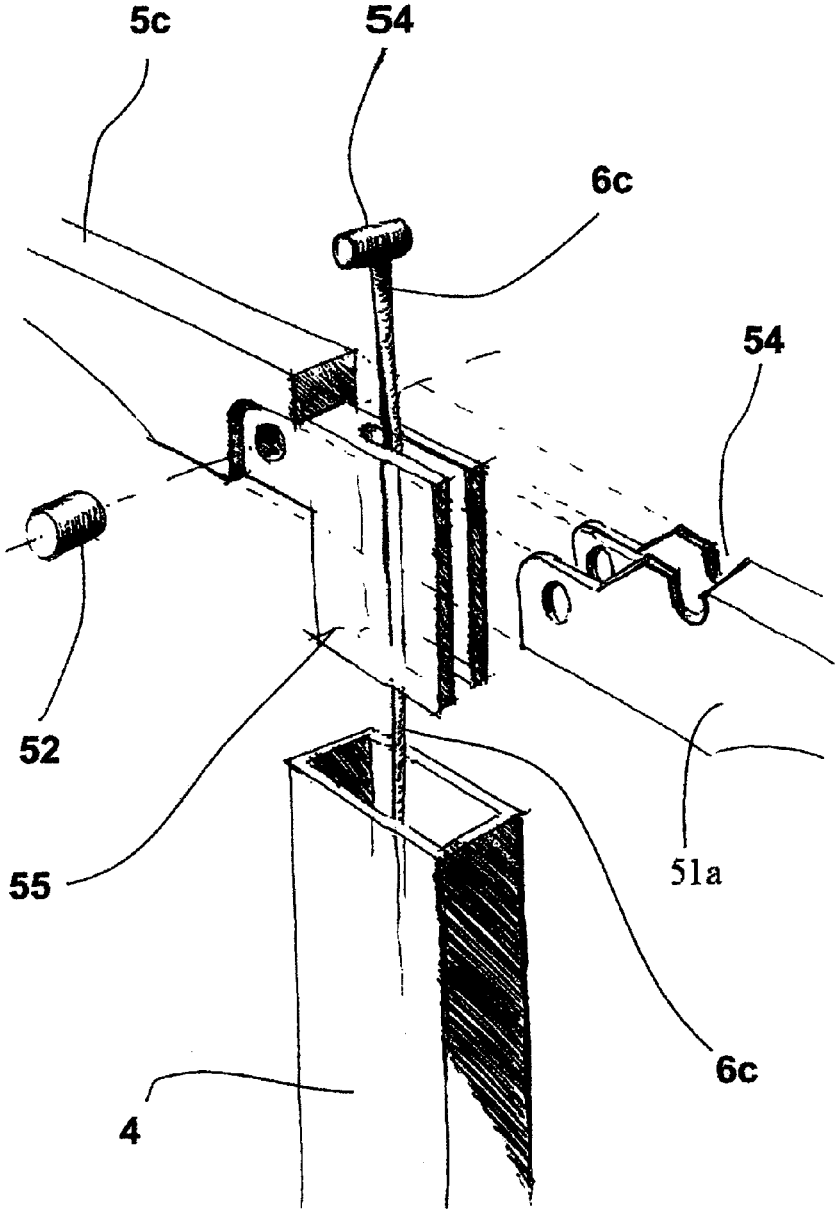

FIG. 13 shows an exploded view of one of the possible embodiments of the upper operating elements.

Figure 14:
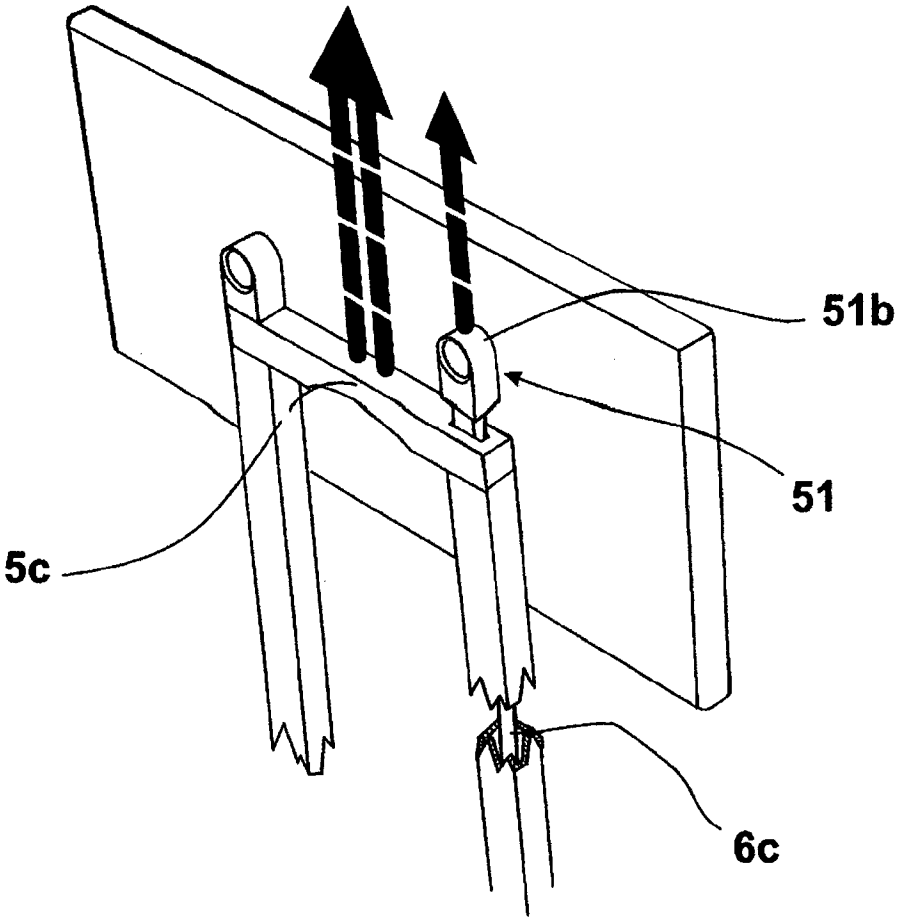

FIG. 14 shows an exploded view of a different possible embodiment of the upper operating elements.

Figure 15:
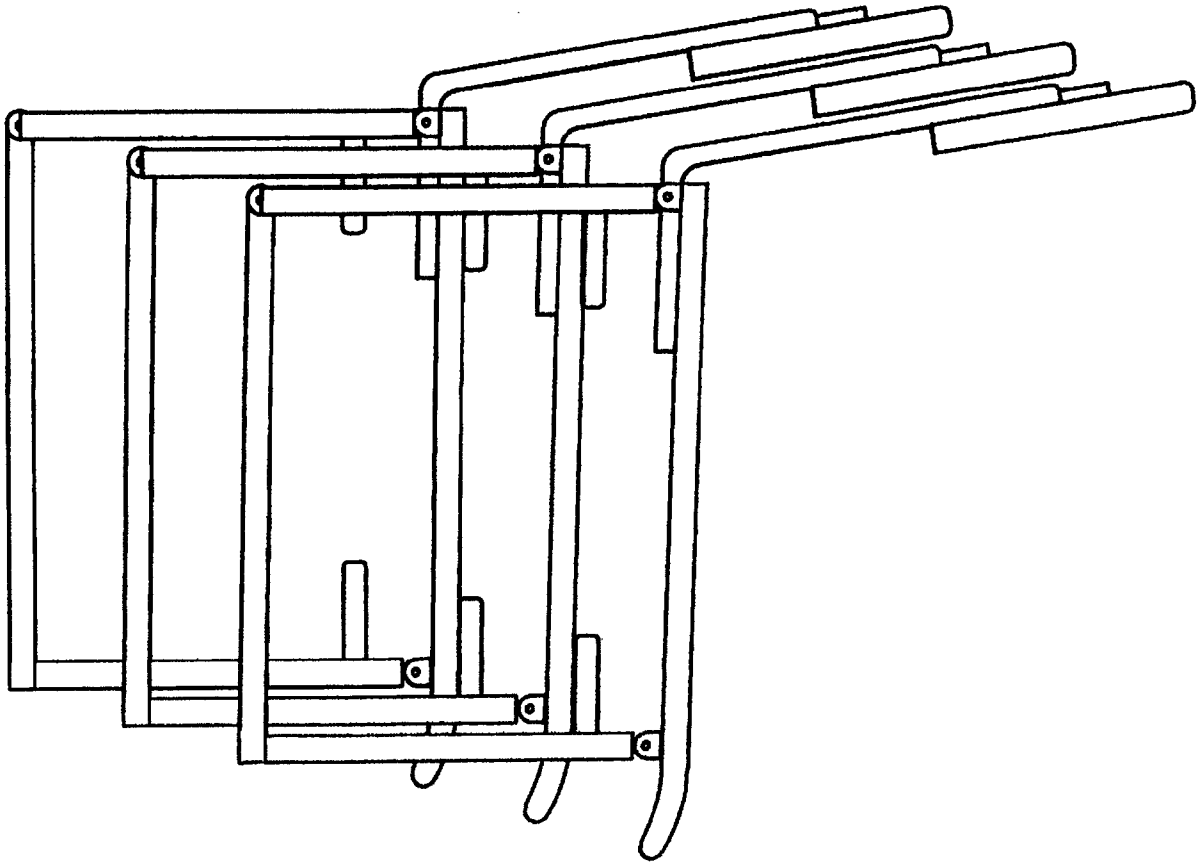

FIG. 15 shows a profile view outline of a stack of a plurality of chairs. In this case it is the version of the frame that is shown in FIGS. 4F and 5. All chairs are in their lowest possible position without inclination in any direction.

Figure 16:
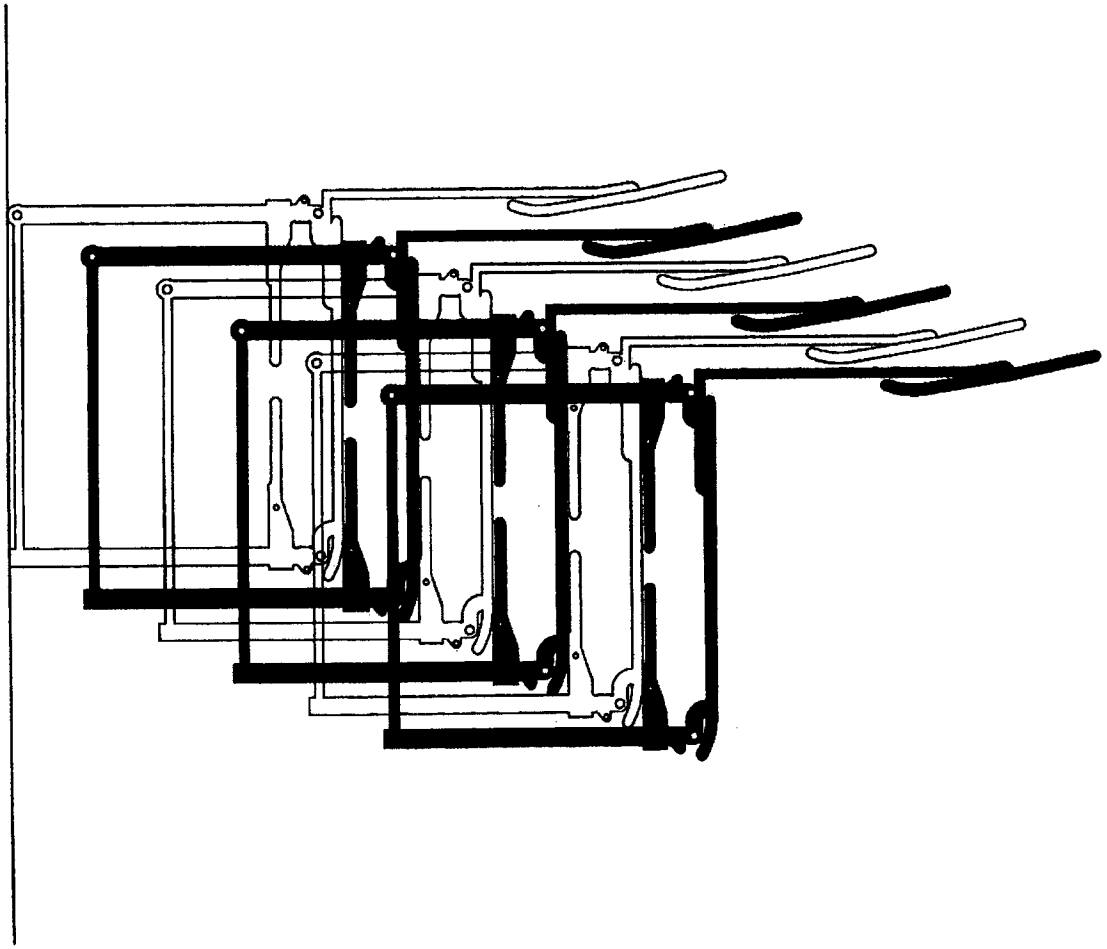

(FIGS. 16-20 illustrate a variation):

FIG. 16 shows a profile view outline of a stack of a plurality of chairs. In this case it is a frame version with latching cross braces as shown in FIGS. 4F and 5, which also show the position of the operating elements of the chair variation with the external locking device. All chairs are shown in the lowest possible position without inclination in any direction.

FIG. 17 comprises drawings A, B, C, D, and E:

Drawing A shows a longitudinal section through a front leg which shows the operating element (5) in neutral center position between frictional resistance/mechanical resistance (30*e*) and spring tab [spring] (30*f*); the lock piece (33*a*) is latched into the latch profile (32*a*); the locking device prevents the second telescopic segment of the leg from sliding into the first telescopic segment.

Drawing B shows a longitudinal section through an operating element on the front leg which shows how the moveable locking device (33) yields when the telescopic leg is pulled out; the operating element (5) remains in the neutral center position between frictional resistance/mechanical resistance (30*c*) and spring tab [spring] (30*f*).

Drawing C shows a longitudinal section through an operating element on the front leg which shows how the completely released locking device (33) also releases the pushing together of the telescopic leg; to this end the operating element (5) is moved against the elasticity of the spring tab [spring] (30*f*) and maintains the locking device in a neutral position on its lateral lift extension (33*e*); the second telescopic segment of the leg (32), due to its own weight and the weight of the above structures, moves into the first telescopic segment (31); (in all of these side views the outlines of the lateral lift extension (33*e*) and the lock piece (33*a*) are congruent).

Drawing D shows a longitudinal section through an operating element on the front leg which shows how the moveable locking device (33) completely blocks the telescopic function; the operating element (5) is in the locked position and is kept in this position by the frictional resistance/mechanical resistance (30*e*); the end of the lever load arm (53) of the operating element blocks the locking device due to being opposite the lateral locking device extension (33*f*) of the same; the lock piece (33*a*) remains latched in a latch stage of the latch profile (32*a*) and thus blocks any movement of the second telescopic segment of the leg (32) in the first telescopic segment (31) in both directions.

Drawing E shows a longitudinal section through an operating element on the front leg; the second telescopic segment of the leg (32) is extended past the intended maximum length; the operating element is in a neutral center position; the lock piece (33*a*) of the moveable locking device (33) latches into a last notch that has a threshold on its lower end on which the lock pin catches; the second telescopic segment/the upper leg shaft cannot slide out any further; the effect is that of a slip safeguard.

Figure 18:
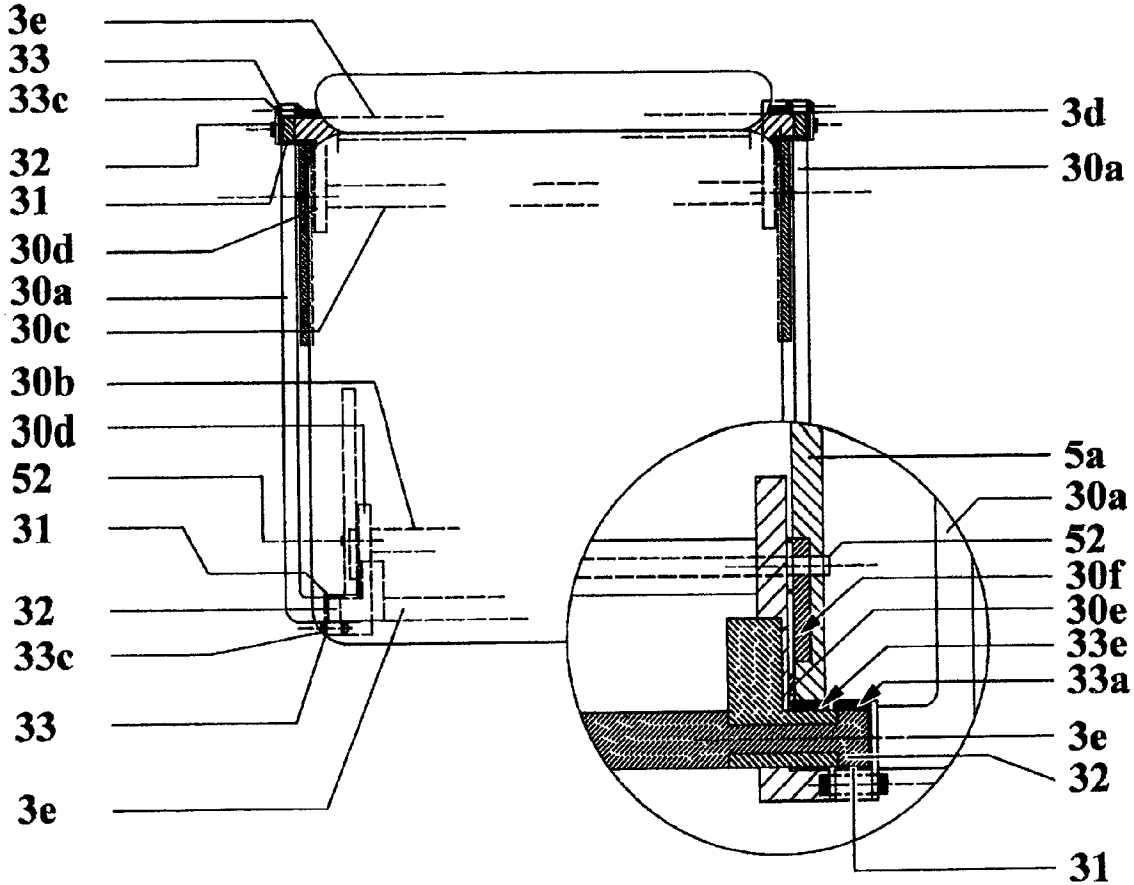

FIG. 18 shows an outline with operating elements and locking devices and also shows the position of the braces that was introduced in the perspective presentation of FIG. 4F.

Figure 19:
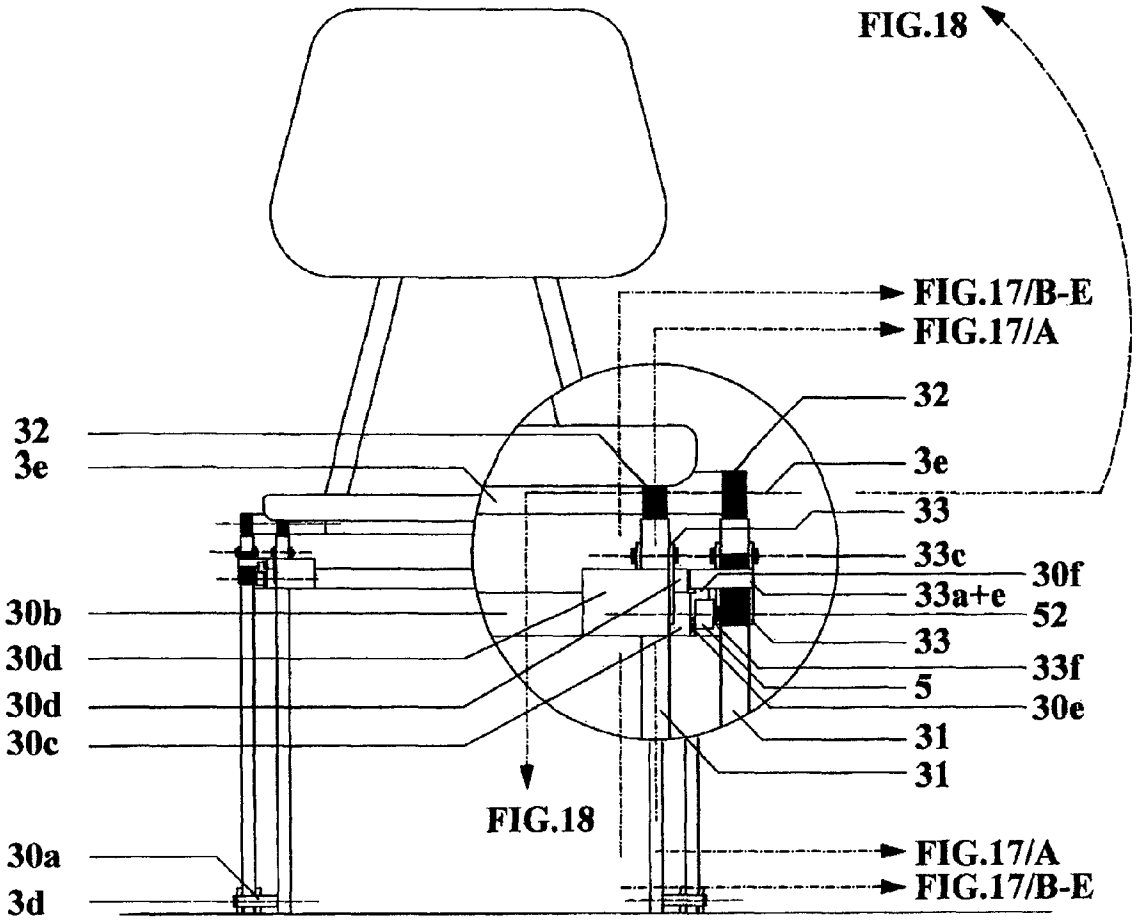

FIG. 19 shows an elevation of the chair from the front.

Figure 1:
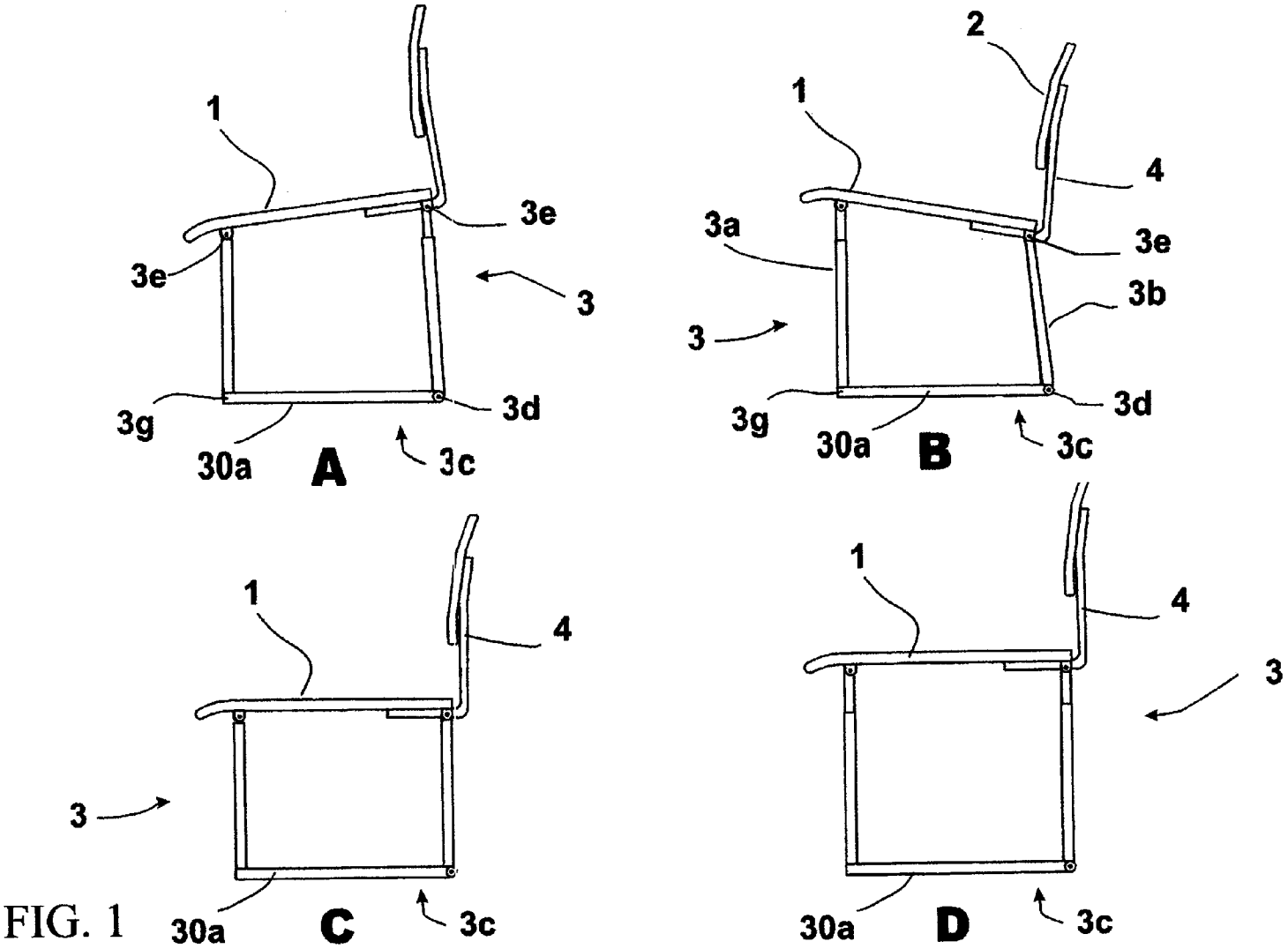
FIG. 1 shows the embodiment of a chair with articulated hinges at the upper front and rear and lower rear and comprises drawings A, B, C, and D.

FIG. 20 is the equivalent of FIG. 1, here, however, for the variation in which the operating elements control external locking devices and also can be operated with a foot; it comprises drawings A, B, C, and D:

Drawing A, a profile view outline, shows how the adjustability of the frame allows for a reduction of the seat height, here with the operating elements in the blocked position.

Drawing B, a profile view outline, shows how the adjustability of the frame allows for a forward inclination of the seat, here with the operating elements in the neutral center position.

Drawing C, a profile view outline, shows how the adjustability of the frame allows for a backward inclination of the seat, here with the operating elements in the neutral center position.

Drawing D, a profile view outline, shows how the adjustability of the frame allows for an increase in the seat height, here also with the operating elements in the neutral center position.

PARTS LIST (1) seat platform (2) chair back (3) adjustable frame (3*a*) front legs (3*b*) rear legs (3*c*) braces of the adjustable frame (3) (e.g. two longitudinal braces and a front and/or a rear cross brace (3*d*) lower articulated hinge (lower moveable intermediate piece in the frame)

(3*c*) upper articulated hinge (upper moveable intermediate piece in the frame)

(3*f*) cavity of the stacking fit (3*g*) rigid connection in the adjustable frame (3) (rigid intermediate part in the frame)

(30*a*) longitudinal braces
(30*b*) front cross brace
(30*c*) rear cross brace
(30*d*) displacing/indenting connecting piece between front/rear cross brace and legs
(30*e*) frictional/mechanical resistance
(30*f*) spring tab [spring of the operating element]
(31) first telescopic segment of the leg
(31*a*) openings for the locking device
(32) second telescopic segment of the leg
(32*a*) latch profile for the locking device
(33) moveable locking device
(33*a*) lock pin or lock piece of the moveable locking device (33)
(33*b*) spring of the moveable locking device (33)
(33*c*) axis of the moveable locking device (33)
(33*d*) anchor of a transfer device on the locking device
(33*e*) lateral extension (lift extension) of the moveable locking device (33)
(33*f*) lateral extension (blocking extension) of the moveable locking device (33)
(4) upper frame extension
(5) operating device
(5*a*) front operating device
(5*b*) rear operating device
(5*c*) element for simultaneous operation
(5*d*) upper operating devices
(51) operating handles
(51*a*) pivoting handle (operating handle)
(51*b*) pull handle (operating handle)
(52) axis of an operating device
(53) lever arm/load arm/[extension of an operating device] (5)
(54) anchor of a transfer device on the operating device
(55) pin in a fitting
(6) transfer device (cable pull)
(6*a*) front cable pulls
(6*b*) rear cable pulls
(6*c*) upper cable pulls

DETAILED DESCRIPTION

Seat furniture with quickly adjustable frame, the frame being adjustable such that the height and inclination of the seat supported by said frame can be easily and rapidly adjusted, characterized by:

a seat platform,
an adjustable frame that supports said seat platform,
at least one group of legs, which are integrated into said adjustable frame and which include devices for height-adjusting the position of the legs,
operating devices for operating said devices for adjusting the position,
said operating devices being accessible from outside and
said devices for adjusting the position comprising locking devices that are operated by means of said operating devices.

The present invention is comprised of seat furniture with quickly adjustable frame, comprised of a seat platform (1) that is supported by an adjustable frame (3) into which two pairs of legs (3*a*)(3*b*) are integrated, whose devices for adjusting the height (31*a*/32*a*) (33)(5) comprise locking devices (33) which in turn are operated by means of operating devices (5*a*)(5*b*) that are located near the seat platform (1).

The seat furniture that is introduced comprises a seat platform (1) that is supported by an adjustable frame (3). This adjustable frame (3) can comprise one or a plurality of groups of legs (e.g. a total of three, four or even more legs) that comprise devices (31*a*/32*a*)(33)(5) for adjusting their height. In a preferred embodiment the adjustable frame (3) comprises two pairs of legs: a front pair of legs (3*a*) and a rear pair of legs (3*b*). In the lower part of the adjustable structure (3) the pairs of legs (3*a*)(3*b*) are connected by means of braces (3*c*) (in the present case with two lateral braces (30*a*) and a front brace (30*b*) and/or a rear brace (30*c*)).

With regard to the front and rear braces (30*b*)(30*c*) there were considerations to allow them to latch into the inside of the adjustable frame in the area between the legs of a pair (3*a*) or (3*b*) that are connected by them.

In accordance with the above, multi-angular sub-groups form on the sides between seat platform (1), chair legs (3*a*) (3*b*) and longitudinal braces (30*a*). Now, on one hand there are moveable intermediate parts in each structural sub-group, e.g. articulated hinges (3*e*)(3*d*), that ensure that said structure is adjustable because they allow for the independent adjustment of front (3*a*) and rear (3*b*) pairs of legs. On the other hand, each structural sub-group comprises a rigid intermediate part (3*g*) that limits the adjustability of the structure and ensures that the adjustable frame (3) stands securely.

The legs (3*a*)(3*b*) have a telescope-like structure that comprises a first-lower- and a second-upper-telescopic segment (31)(32). In the embodiment shown in FIGS. 1-15, the first telescopic segment (31) comprises a plurality of openings (31*a*) at different heights. Furthermore, the second telescopic segment comprises a moveable locking device (33) which operates by means of the pressure of a spring (33*b*). Said moveable locking device (33) moves around its own axis (33*c*) and one hand ends in a lock pin (33*a*) while, on the other hand, it provides an anchoring device (33*d*) for a pull device/transfer device (6). [Alternative, moveable locking devices are feasible, e.g. gliding pins with a deflection device onto which the operating pull or pressure is exerted].

This mechanism allows for said moveable locking device to comprise three phases: 1. locking in both directions; 2. yielding when the adjustable structure (3) is pulled out and simultaneously blocking the adjustable structure when pushed together; 3. completely open. Each phase is determined by the respective degree of action on the operating devices. [A simpler version could work with two phases: 1. locking in both directions; 2. completely open].

The transfer device (6) can be comprised of a cable pull that runs on the inside of the legs (3*a*)(3*b*) up to an operating device (5) which controls the position of the locking device (33) or, respectively, the lock pin (33*a*) with regard to the openings (31*a*). [In a more primitive embodiment the operation could be directly on the transfer device (cable/chain/elastic pull or rigid pressure device].

The operating devices (5) are located near the seat platform (1) and can easily be reached by the user. The operating device is comprised of a handle (51) that rotates around its own axis (52). The anchoring devices (54) which connect the transfer device (6) and the operating device (5) are located away from the center of the axis.

Furthermore, the adjustable frame (3) can comprise an extension (4) that points upward, said extension carrying a chair back (2) so that the overall composition forms a chair.

There also are provisions for a front operating device (5*a*) to control the front legs (3*a*) and a rear operating device (5*a*) to control the rear legs (3*b*). Thus the front operating device (5*a*) allows for controlling the moveable front locking devices (33) by means of the transfer device (6*a*) in order to vary the length of the front legs (3*a*). In the same manner the rear operating device (5*b*) allows for controlling the moveable rear locking devices (33) by means of the transfer device (6*b*) in order to vary the length of the rear legs (3*b*). This means the simultaneous operation of the front and rear operating elements (5*a*)(5*b*) allows for varying the height of the seat platform while the independence of said elements makes it possible to vary the inclination of the seat.

In addition, it is possible to fasten additional operating elements (5) to the upper frame extension (4) in the area of the chair back (2) (having the same effect as those that are in the area of the seat platform (1)). In a possible embodiment these can be two upper operating elements (5*d*), each attaching to an anchoring device (54) of the lever arms (53) of the front and rear operating device (5*a*)(5*b*) by means of upper transfer devices or cable pulls (6*c*). In this manner the upper operating elements (5*d*) function via the front and rear operating elements (5*a*)(5*b*) that are mentioned, said operating elements in turn being arranged in the area of the seat platform (1).

[In general especially the use of flexible transfer elements allows for the possibility to move the respective operating devices into any area of the object: near the floor (pedals), between seat and back, to arm rests etc.].

In a different embodiment a device for simultaneous operation (5*c*) is included, which may be inserted into the upper frame extension (4) by means of pins (55), for example, and combines the front and rear operating device (5*a*)(5*b*). In another possible embodiment this simultaneous operation provides a hinge for two upper operating devices, which are like pivoting handles (51*a*). In a simpler embodiment these handles can be pull handles (51*b*). Said handles (51) allow for the separate operation of the front and rear operating devices (5*a*)(5*b*).

The adjustable frame (3) comprises rigid connections (3*g*), upper hinges (3*e*) (these can also be continuous axes) that connect said frame with the seat platform (1), and lower hinges (3*d*) that allow for a certain movability between the leg pairs (3*a*)(3*b*), which ensures the independent adjustment of the leg pairs. With this in mind, different embodiments were taken into consideration, e.g.:

- two groups of upper hinges (3*e*), a group of lower rear rigid connections (3*g*) and a group of lower front hinges (3*d*);
- two groups of upper hinges (3*c*), a group of lower front rigid connections (3*g*) and a group of lower rear hinges (3*d*);
- two groups of lower hinges (3*d*), a group of upper rear rigid connections (3*g*) and a group of upper front hinges (3*c*);
- two groups of lower hinges (3*d*), a group of upper front rigid connections (3*g*) and a group of upper rear hinges (3*e*).

In one variation, which is depicted in FIGS. 16-20, the position of the moveable locking devices (33) on the telescopic legs is moved to the outside while the operating elements are in a position that allows them to be operated by foot. This variation is depicted in the frame embodiment shown in FIG. 4F.

The front and rear latching cross braces—in addition to providing a stabilizing function for the adjustable frame (3)—carry the axes (52) of the operating elements. These operating elements (5), in the present case pivoting levers (51*a*), each are arranged at both ends of said axes. Since the load arms/[extensions] of lever mechanisms are connected in a fixed manner to the right and left to their respective pivot pins, a lever arm for the front axis and a lever arm for the rear axis theoretically would be sufficient for operating purposes. However, in practical applications operability from both sides is desired, which would suggest doubling the operating levers.

This means the effect of each operating lever pair, the front one and the rear one, is synchronized. Each operating element is a lever whose lever arm acts as the operating handle—in the position presented here it can also be operated by foot—while the other lever extension, the load arm/operating [device extension] acts between the lateral extensions (33*e*)(33*f*) of the moveable locking device.

Said moveable locking device moves around the axis (33*c*) of a hinge that is arranged near the upper end of the first/lower telescopic segment (31) of the leg. The locking device (33) on one hand ends with a cross piece, which we call lock pin (33*a*) here, and falls onto a latch profile (32*a*) merely due to the own weight of the locking device, said latch profile being part of the second/upper telescopic segment (32) of the leg, while on the other side said locking device provides two lateral extensions: one (33*c*)—the upper one—constitutes the device that ensures the transfer of the movement of the lever (53) onto the locking device, while the other (33*f*)—the lower one—supports the function of blocking the locking device (33) on the latch profile (32*a*).

In the embodiment that is shown in FIG. 17, the operating elements (5) have a vertical direction of motion that comprises three function positions with regard to the telescopic legs.

The mechanism as a whole ensures that the moveable locking device (33) comprises three phases with the following functions: 1.: blocking in both directions when the load arm (53) of the operating lever blocks the locking device (33) onto the latch profile (32*a*) by means of its lateral extension (33*f*); 2.: yielding when pulling apart and—in the same constellation—blocking when the adjustable frame (3) is pushed together while the operating element is in its neutral center position; 3.: completely open when the operating element lifts the locking device (33) on its lateral transfer or, respectively, lift extension (33*c*).

There is some clearance between the respective lateral extensions (33*e*)(33*f*) of the moveable locking device on the lever arm (53) of the lever. When the operating element is in its neutral center position, the locking device is freely moveable in its functional are segment when the telescopic leg is pulled out.

Furthermore there are two devices that control the position of the operating elements (5) (in the present case these are in the area of the displacing connecting pieces (30*d*) that allow the cross braces (33*b*)(33*c*) to latch into the inside of the adjustable frame (3)): To get out of the position of complete blocking, the lever arm must pass a frictional resistance/mechanical resistance. (30*e*). Past this frictional resistance the operating element is in its neutral center position. From this position on the continuation of its movement is slowed down by a spring tab (30*f*) [or any other kind of elastic medium], which returns the operating element to its neutral center position following the complete opening of the locking device (33), allowing said locking device to fall back onto the latch profile (32*a*) due to its own weight.

The operating elements extend on both sides in longitudinal direction below the seat. The front pair is opposite the rear one, the opposite lever ends are close or are almost touching, said position allowing for a simultaneous operation by hand or foot on either side. [Alternative operating elements (e.g. rotating knobs) or opposite facing attachments are possible, however, are hardly conducive to simultaneous operation].

In order to prevent the separation of the telescopic segments of the legs when they are pulled out beyond the intended maximum length, the lower end of the latch profile (32*a*) comprises a notch with a threshold at its lower end on which the lock pin (33*a*) catches, preventing the second telescopic segment (32) of the leg from sliding out further from the first telescopic segment (31), as can be seen in FIG. 17E.

When operating the front operating device (5*a*) from its position of complete locking up to a center position, the moveable locking devices (33) of the front leg pair (3*a*) are unlocked so said leg pair can be pulled out. At this point it is possible to increase the length of the front leg pair (3*a*). In a gradual operation of the rear operating device (5*b*) the moveable locking devices (33) of the rear leg pair (3*b*) are unlocked in the same manner up to a center position so said leg pair can be pulled out. Now the length of this leg pair can be increased as well.

In the center position of the operating elements (5) that was just mentioned, the locking devices yield when the telescopic leg pairs (3*a*)(3*b*) are pulled out and in the process produce "clicks" when the locking devices latch halfway into one opening (31*a*) for the locking device (FIG. 8D) after the other during operation or fall onto one latch stage (32*a*) after another (FIG. 17B). These clicks that are audible and can even be felt by sensitive hands, allow for a higher degree of control for reaching the desired seat position. In the same situation the locking devices block the movement in the opposite direction (when pushing the telescopic legs together). The openings for the locking device can be visible on the outside in order to also ensure optical control when operating the locking device, a control which also is provided for the variation with the external locking device, be it due to visible latching of the lock pin (33*a*) into a certain latch stage or be it due to a visible number of latch stages that have already been pulled out from the first telescopic segment of the leg.

When the front leg pair (3*a*) is higher than the rear leg pair (3*b*), the seat (1) is inclined backward. When, on the other hand, the rear leg pair (3*b*) is higher than the front leg pair (3*a*), the seat is inclined forward. When the corresponding operating elements are operated simultaneously, the height of both leg pairs (3*a*)(3*b*) can be adjusted while maintaining the inclination of the seat (1). The position of the operating elements that corresponds to the complete opening of the locking devices ensures both operations on the adjustable frame: pulling out and/or pushing together.

The configuration of the adjustable frame (3), in particular in regard to the rear legs (3*b*) and the braces (30*a*)(30*b*)(30*c*) is such that a cavity for a stacking fit remains, which is compatible with the shape and the dimensions of the seat platform (1) and the other structural elements, consequently allowing the stacking of several units on top of the other. With this in mind, the rear legs (3*b*) are situated outside the lateral limits of the seat platform (1) and also outside the width of the front legs (3*a*). This disposition of the frame (3) defines, together with a lack of a rear cross brace (3*c*) (as is shown in FIG. 3) the cavity of the stacking fit (3*f*).

A different embodiment, e.g. one in which two cross braces (30*b*)(30*c*) latch towards the inside of the frame (as shown in FIGS. 4F and 5 or in FIGS. 16-20), offers secure stacking support and leaves the area adjacent to the seat platform (1) free.

Since the last mentioned variation is the required frame variation for the seat furniture with externally fixed locking devices, a position of the operating elements (5) was found that does not impact the stackability of a plurality of units since they do not extend into the cavity of the stacking fit when in the blocking position. Since, in addition, the highest setting of the operating lever coincides with the blocking of the mechanism, it cannot inadvertently open when a chair is pulled from the stack or when chairs are stacked (FIG. 16).

It should be mentioned that in a frame embodiment with latching cross braces, shown in FIG. 4F, the stabilizing effect for the adjustable frame is combined with an ergonomic advantage: the person that sits [on the chair] can tuck his feet under the chair or can cross them under the chair.

The present invention can undoubtedly be modified in regard to the individual details concerning shape and design in practical applications, which does not mean that they move away from the basic aspects that are defined in the following patent claim clauses.

The invention claimed is:

1. Seat furniture with a quickly adjustable frame, the frame being adjustable such that a height and inclination of a seat supported by the frame can be easily and rapidly adjusted, comprising:

a seat platform, an adjustable frame that supports the seat platform, at least one group of legs integrated into the adjustable frame and which include devices for height-adjusting positions of the legs, operating devices for operating the devices for adjusting the positions, the operating devices being accessible from outside and the devices for height-adjusting the positions comprising locking devices that are operated by the operating devices, and two frame structures related to each other in a telescopic manner, the frame structures comprising:

an upper frame structure with four latched upper leg shafts inserted into a base frame structure with four lower leg tubes that accommodate the upper leg shafts, the lower leg tubes each having a locking mechanism on an upper opening thereof that can block or allow the pushing in or pulling out of the upper leg shafts, the upper frame structure having the seat and a chair back which are connected in a fixed manner, wherein axes that connect respective front and rear upper leg shafts which in turn can pivot in longitudinal direction are arranged below the seat area of the chair seat, the base frame structure having respective front and rear lower leg tube pairs which are connected in a rigid manner by a cross brace independent of the upper frame structure, while laterally the lower leg tubes are connected with blade-type longitudinal braces near the floor, the braces being fixed in a rigid manner in a front thereof but being connected to the leg tubes by hinges with longitudinal pivoting direction on a same plane in a rear thereof, the two frame structures forming a dynamic integral frame due to telescope-like sliding together of the shafts and tubes, the frame allowing for the adjustment of the chair with regard to height and inclination of the seat with a base area that remains the same, and a locking and operating mechanism comprising:

four locking devices that are suspended on hinges on the front or, respectively, rear outside edges of the upper openings of the lower leg tubes and having locking pins that are below level of the hinges and fall onto a latch profile of a respective upper leg segment, each yielding in reaction to a pulling out of the telescopic leg shafts from respective lower leg tubes and blocking a sliding back of the upper leg shafts into the respective lower leg tubes, each locking device carrying two lateral extensions on inside flanks thereof, the two lateral extensions being a lift extension at a top of the locking device and a locking extension at a bottom of the locking device, four operating levers connected in pairs by cross axes which in turn run in the cross braces of the base frame structure and which offer three operating positions in a vertical direction of movement with regard to the locking devices, the operating levers having lever arms below the seat that taper to the right and left in longitudinal directions of two axes thereof and have lever extensions that taper on another side of the axes towards an area between the lateral extensions of a respective locking device, wherein downward operation of the levers allows for a paired active opening by lifting of the locking devices while upward operation of the levers up to their highest position moves the load arms downward before the lower lateral locking extensions of the locking devices and blocks them completely in a position in a respective stage of the profile, the lateral extensions of the locking devices and the operating levers being aligned so that there is a neutral pivoting clearing for the levers between the lateral extensions of the locking devices which in turn provides the locking devices with free reaction clearance so that they can react passively to protrusion and retraction of the latch stages as soon as the upper leg shafts, which rub against the lock pins, are pulled out, spring tabs having spring pressure for pushing back the operating levers following operation in a direction of a complete open position into a center neutral position, and mechanical resistances that the operating levers must overcome in a frictional manner in order to get from the center neutral position to a position of complete blockage or, vice versa, to get from the total blockage position to the center neutral position, such that the operating mechanism allows for adjustment of height and inclination of the seat with at least one of one hand and one foot, and such that reaching of a position can be determined by at least one of a tactile, acoustic, and an optical manner.

2. Seat furniture with quickly adjustable frame in accordance with claim 1, wherein the rear legs are at a greater distance from one another than a distance between outside flanks of the front legs, wherein the longitudinal braces running near the floor extend laterally on the outside from the front legs and taper vertically towards the rear legs towards the rear, wherein the lateral extensions of the locking devices as well as the operating levers that run between these extensions, thus the operating clearances of the deflection mechanisms, fit spatially between inside flanks of their respective assigned leg pairs, which is made possible by arrangement of the axes of the lever mechanisms on the upper cross braces of the base frame structure that are connected in a rigid manner with their respective front and rear chair legs by connecting pieces that displace the cross braces to an inside below the frame so that no frame or operating element in the front sector of the chair protrudes into a vertical spatial plane behind the front legs and no frame or operating element protrudes into a vertical spatial plane before the rear legs in a rear sector of the chair, and wherein neither the lateral extensions of the locking devices nor the connecting pieces, nor the lever axes nor the operating levers in their highest position of complete locking are below the spatial plane that is marked by the two cross braces of the base frame structure and the stacking of a plurality of chairs from the front and from the top is permitted.

3. Seat furniture with a quickly adjustable frame, the frame being adjustable such that a height and inclination of the seat supported by the frame can be easily and rapidly adjusted, comprising:

a pair of front legs and a pair of rear legs, wherein the legs each comprise a first telescopic segment and a second telescopic segment and wherein each second telescopic segment can be pushed into and pulled out from the first telescopic segment for adjusting the height of the legs, a seat platform which is connected with the upper ends of the legs, a first and a second longitudinal brace which each connect a lower end of one of the front legs with a lower end of one of the rear legs, respectively, wherein one of the connections between an upper end of a front leg and the seat platform, between an upper end of a rear leg and the seat platform, between a lower end of a front leg and a related longitudinal brace and a lower end of a rear leg and a related longitudinal brace is provided by a rigid connection, and wherein the other three connections are each provided by articulated hinges, an adjusting device and a locking device at each leg, for adjusting and locking, respectively, a position of a height of the leg, a front operating device for operating the locking devices at both front legs, and a rear operating device for operating the locking devices at both rear legs wherein the locking devices each comprises a lock which can be operated by a related one of the operatings device in such a manner that:

in a first phase a pushing together and a pulling out of the first and second telescopic segments is blocked, in a second phase a pushing together of the first and second telescopic segments is blocked and a pulling out of the first and second telescopic segments is enabled, and in a third phase a pushing together and a pulling out of the first and second telescopic segments is enabled wherein each of the second telescopic segments is provided along its length with a latch profile, each lock being pivotably supported at the upper end of a respective first telescopic segment and comprises a lock pin for engaging into the latch profile, a lateral upper extension for unlocking the lock, and a lateral lower extension for blocking the lock, and the front and the rear operating devices each comprising a lever arm which by turning the operating device into a first position during the first phase blocks the lock pin on the latch profile by the lateral lower extension which, by turning the operating device into an opposite second position during the third phase, pulls out the lock pin from the latch profile by the lateral upper extension, and wherein in a neutral center position of the operating device during the second phase the lock pin rests with its own weight on the latch profile and the lock is freely moveable on an arc segment for pulling out the telescopic segments.

4. Seat furniture in accordance with claim 3, wherein the front operating device and the rear operating device are each provided with a spring for pre-tensioning the operating device from the second position into the neutral center position.

5. Seat furniture in accordance with claim 3, wherein the front operating device and the rear operating device are each pivotable in a vertical plane and supported at a cross brace which latter connects two front legs and two rear legs, respectively, with each other.

6. Seat furniture in accordance with claim 3, wherein for turning the front operating device and the rear operating device, respectively, from the first position into the neutral center position, the lever arm must pass a frictional resistance.

7. Seat furniture in accordance with claim 3, wherein by pulling out the telescopic segments during the second phase, audible impact sounds are produced.

8. Seat furniture in accordance with claim 3, wherein a stacking fit for stacking several seat furniture is provided by situating the rear legs outside the lateral limits of the seat platform and also outside the width of the front legs.

9. Seat furniture in accordance with claim 8, comprising a front cross brace and a rear cross brace, connecting the front legs and the rear legs, respectively, and both latching into the inside of the frame with regard to the legs which they connect and by this provide a stacking support and leaving an area adjacent to the seat platform free.

* * * * *